US009184040B2

(12) United States Patent
Park

(10) Patent No.: US 9,184,040 B2
(45) Date of Patent: Nov. 10, 2015

(54) ABRIDGED MULTIPOLE STRUCTURE FOR THE TRANSPORT AND SELECTION OF IONS IN A VACUUM SYSTEM

(75) Inventor: Melvin Andrew Park, Billerica, MA (US)

(73) Assignee: Bruker Daltonics, Inc., Billerica, MA (US)

( * ) Notice: Subject to any disclaimer, the term of this patent is extended or adjusted under 35 U.S.C. 154(b) by 0 days.

(21) Appl. No.: 13/152,363

(22) Filed: Jun. 3, 2011

(65) Prior Publication Data

US 2012/0305758 A1 Dec. 6, 2012

(51) Int. Cl.

*H01J 49/26* (2006.01)
*H01J 49/42* (2006.01)
*H01J 49/06* (2006.01)

(52) U.S. Cl.

CPC ..... *H01J 49/421* (2013.01); *H01J 49/063* (2013.01); *H01J 49/4255* (2013.01); *H01J 49/4235* (2013.01)

(58) Field of Classification Search

CPC . H01J 49/063; H01J 49/4215; H01J 49/4225; H01J 37/3007; H01J 49/065; H01J 49/421; H01J 49/4235; H01J 49/4255
USPC ..... 250/281, 290–292, 294, 396 R
See application file for complete search history.

(56) References Cited

U.S. PATENT DOCUMENTS 3,648,046 A * 3/1972 Denison et al. ..... 250/281
4,556,823 A * 12/1985 Keller et al. ..... 315/111.81
4,963,736 A 10/1990 Douglas
5,283,436 A 2/1994 Wang
5,652,427 A 7/1997 Whitehouse
5,726,448 A * 3/1998 Smith et al. ..... 250/290
5,763,878 A 6/1998 Franzen
5,847,386 A 12/1998 Thomson
5,965,884 A 10/1999 Laiko
6,157,031 A * 12/2000 Prestage ..... 250/292
6,465,792 B1 * 10/2002 Baptist ..... 250/396 R
6,576,895 B1 * 6/2003 Park ..... 250/287
6,756,599 B2 * 6/2004 Kienzle ..... 250/492.2
6,787,760 B2 9/2004 Belov
6,911,650 B1 6/2005 Park
6,956,202 B2 10/2005 Park (Continued)

OTHER PUBLICATIONS

Torgerson, D.F., Skowronski, R.P. and Macfarlane, R. D., "New Approach to the Mass Spectroscopy of Non-volatile Compounds", Biochemical and Biophysical Research Communications, v. 60, n. 2, pp. 616-621 (1974).

(Continued)

*Primary Examiner* — Jack Berman
*Assistant Examiner* — Wyatt Stoffa
(74) *Attorney, Agent, or Firm* — O'Shea Getz P.C.

(57) ABSTRACT

An abridged multipole structure for the transport and selection of ions along a central axis in a vacuum system is constructed from a plurality of rectilinear electrode structures, each having a substantially planar face with a first dimension and a second dimension perpendicular to the first dimension. When a voltage is applied across the second dimension, an electrical potential is produced at the planar face whose amplitude is a linear function of position along the second dimension. Two electrode structures can be arranged parallel to each other with the first dimension extending along the central axis or more electrodes structures can be arranged to form multipole structures with various polygonal cross sections.

27 Claims, 19 Drawing Sheets

(56) References Cited

U.S. PATENT DOCUMENTS

| | | | | |
|---|---|---|---|---|
| 7,227,138 | B2 | 6/2007 | Lee | |
| 7,550,717 | B1 * | 6/2009 | Belford et al. | 250/281 |
| 7,723,679 | B2 | 5/2010 | Tolley | |
| 7,829,849 | B2 * | 11/2010 | Giles | 250/290 |
| 7,858,934 | B2 * | 12/2010 | Belford et al. | 250/293 |
| 8,008,618 | B2 * | 8/2011 | Londry | 250/283 |
| 8,067,747 | B2 * | 11/2011 | Wollnik | 250/396 R |
| 2001/0035498 | A1 * | 11/2001 | Li et al. | 250/398 |
| 2004/0026614 | A1 * | 2/2004 | Bateman et al. | 250/281 |
| 2004/0246755 | A1 * | 12/2004 | Isii et al. | 363/131 |
| 2006/0016981 | A1 * | 1/2006 | Park | 250/288 |
| 2006/0038121 | A1 * | 2/2006 | Guevremont | 250/290 |
| 2008/0017794 | A1 * | 1/2008 | Verbeck | 250/292 |
| 2008/0210859 | A1 * | 9/2008 | Tolley et al. | 250/282 |
| 2008/0265154 | A1 * | 10/2008 | Cousins et al. | 250/288 |
| 2009/0159796 | A1 * | 6/2009 | Belford et al. | 250/294 |
| 2009/0206250 | A1 * | 8/2009 | Wollnik | 250/290 |
| 2009/0321655 | A1 * | 12/2009 | Makarov et al. | 250/396 R |
| 2010/0044558 | A1 * | 2/2010 | Sudakov | 250/281 |
| 2010/0308218 | A1 * | 12/2010 | Wang | 250/292 |
| 2011/0133079 | A1 * | 6/2011 | Cousins et al. | 250/294 |
| 2011/0147584 | A1 * | 6/2011 | Kim et al. | 250/292 |
| 2012/0261570 | A1 * | 10/2012 | Shvartsburg et al. | 250/287 |
| 2012/0267526 | A1 * | 10/2012 | Green | 250/290 |

OTHER PUBLICATIONS

Vanbreeman, R.B., Snow, M. and Cotter, R.J., "Time Resolved Laser Desorption Mass Spectrometry.—I Desorption of Preformed Ions", International Journal of Mass Spectrometry and Ion Physics, v. 49, pp. 35-50 (1983), Elsevier Scientific Publishing Company, Amsterdam, Netherlands.

Tabet, J.C. and Cotter, R.J., "Laser Desorption Time-of-Flight Mass Spectrometry of High Mass Molecules", Analytical Chemistry, v. 56, pp. 1662-1667 (1984).

Olthoff, J.K., Lys, I., Demirev, P. and Cotter, R.J., "Modification of Wiley-McLaren TOF Analyzers for Laser Desorption", Analytical Instrumentation, v. 16, n. 1, pp. 93-115 (1987).

Tanaka, K., Waki, H., Ido, Y., Akita, S., Yoshida, Y. and Yoshica, T., "Protein and Polymer Analyses up to m/z 100 000 by Laser Ionization Time-of-flight Mass Spectrometry", Rapid Communications in Mass Spectrometry, v. 2, n. 8, pp. 151-153 (1988).

Karas, M. and Hillenkamp, F., "Laser Desorption Ionization of Proteins with Molecular Masses Exceeding 10 000 Daltons", Analytical Chemistry, v. 60, pp. 2299-2301 (1988).

Dole, M., Mack, L.L., Hines, R.L., Mobley, R.C., Ferguson, L.D. and Alice, M.B., "Molecular Beams of Macroions", The Journal of Chemical Physics, v. 49, n. 5, pp. 2240-2249 (1968).

Chernushevich, I.V., ENS, W. and Standing, K.C., "Orthogonal Injection TOFMS for Analyzing Biomolecules", Analyical Chemistry News and Features, v. 71, n. 13, pp. 452A-461A (1999).

Olivares, J. A., Nguyen, N. T., Yonker, C.R. and Smith, R.D., "On-line Mass Spectrometric Detection for Capillary Zone Electrophoresis", Analytical Chemistry, v. 59, pp. 1230-1232 (1987).

Smith, R.D., Olivares, J.A., Nguyen, N. T. and Udseth, H.R., "Capillary Zone Electrophoresis—Mass Spectrometry Using an Electrospray Ionization Interface", Analytical Chemistry, v. 60, pp. 436-441 (1988).

Morris, H. R., Paxton, T., Dell, A., Langhorne, J., Berg, M. Bordoli, R.S., Noyes, J. and Bateman, R. H., "High Sensitivity Collisionally-activated Decomposition Tandem Mass Spectrometry on a Novel Quadrupole/Orthogonal-acceleration Time-of-flight Mass Spectrometer", Rapid Communications in Mass Spectrometry, v. 10, pp. 889-896 (1996).

Sakudo, N. and Hayashi, T., "Quadrupole Electrodes with Flat Faces", Review of Scientific Instruments, v. 46, n. 8, pp. 1060-1062 (1975).

Wilhelm, L, Weickhardt, C. and Grotemeyer, J., "Ion Trajectory Calculations for a Quadrupole-ion-trap Reflectron-time-of-flight Hybrid Instrument: Effects of the Initial RF-Phase and the Trapping Time on an Ion Bunch Produced from a Molecular Beam", Rapid Communications in Mass Spectrometry, v. 10, pp. 473-477 (1996).

Qian, M.G. and Lubman, D.M., "Procedures for Tandem Mass Spectrometry on an Ion Trap Storage/Reflectron Time-of-flight Mass Spectrometer" Rapid Communications in Mass Spectrometry, v. 10, pp. 1911-1920 (1996).

He, L. and Lubman, D.M., "Simulation of External Ion Injection, Cooling and Extraction Processes with Simion 6.0 for the Ion Trap/Reflectron Time-of-flight Mass Spectrometer", Rapid Communications in Mass Spectrometry, v. 11, pp. 1467-1477 (1997).

Tanaka, K., Kawatoh, E., Ding, L., Smith, A. and Kumashiro, S., "A MALDI—Quadrupole Ion Trap-TOF Mass Spectrometer", American Society for Mass Spectrometry, Poster TP086, ASMS1999, Dallas Texas, Jun. 1999.

Jiang, G., Li, X., Luo, C., Ding C., and Ding L., "PCB Ion Trap Mass Spectrometer (PCBITMS) Coupled with ESI Source", Presentation at the Proceedings of the 57th ASMS Conference on Mass Spectrometry and Allied Topics, May 31-Jun. 4, 2009.

Peng, Y., Zhang, Z., Hansen B., Wang, M., Hawkins, A., and Austin, D., "Design and performance of the coaxial ion trap: Transferring ions between two trapping regions in one mass analyzer", Presentation at the Proceedings of the 58th ASMS Conference on Mass Spectrometry and Allied Topics, May 31-Jun. 4, 2010.

* cited by examiner

40

ABRIDGED MULTIPOLE STRUCTURE FOR THE TRANSPORT AND SELECTION OF IONS IN A VACUUM SYSTEM

BACKGROUND

The present invention generally relates to an improved method and apparatus for the analysis of samples by mass spectrometry. The apparatus and methods for ion transport and analysis described herein are enhancements of techniques referred to in the literature relating to mass spectrometry—an important tool in the analysis of a wide range of chemical compounds. Specifically, mass spectrometers can be used to determine the molecular weight of sample compounds. The analysis of samples by mass spectrometry consists of three main steps—formation of gas phase ions from sample material, mass analysis of the ions to separate the ions from one another according to ion mass, and detection of the ions. A variety of means and methods exist in the field of mass spectrometry to perform each of these three functions. The particular combination of the means and methods used in a given mass spectrometer determine the characteristics of that instrument.

To mass analyze ions, for example, one might use magnetic (B) or electrostatic (E) analysis, wherein ions passing through a magnetic or electrostatic field will follow a curved path. In a magnetic field, the curvature of the path will be indicative of the momentum-to-charge ratio of the ion. In an electrostatic field, the curvature of the path will be indicative of the kinetic energy-to-charge ratio of the ion. If magnetic and electrostatic analyzers are used consecutively, then both the momentum-to-charge and kinetic energy-to-charge ratios of the ions will be known and the mass of the ion will thereby be determined. Other mass analyzers are the quadrupole (Q), the ion cyclotron resonance (ICR), the time-of-flight (TOF), the orbitrap, and the quadrupole ion trap analyzers. The analyzer used in conjunction with the method described here may be any of these.

Before mass analysis can begin, gas phase ions must be formed from a sample material. If the sample material is sufficiently volatile, ions may be formed by electron ionization (EI) or chemical ionization (CI) of the gas phase sample molecules. Alternatively, for solid samples (e.g., semiconductors, or crystallized materials), ions can be formed by desorption and ionization of sample molecules by bombardment with high energy particles. Further, Secondary Ion Mass Spectrometry (SIMS), for example, uses keV ions to desorb and ionize sample material. In the SIMS process a large amount of energy is deposited in the analyte molecules, resulting in the fragmentation of fragile molecules. This fragmentation is undesirable in that information regarding the original composition of the sample (e.g., the molecular weight of sample molecules) will be lost.

For more labile, fragile molecules, other ionization methods now exist. The plasma desorption (PD) technique was introduced by Macfarlane et al. (D. F. Torgerson, R. P. Skowronski, and R. D. Macfarlane, *Biochem. Biophys. Res Commoun.* 60 (1974) 616)("McFarlane"). Macfarlane discovered that the impact of high energy (MeV) ions on a surface, like SIMS would cause desorption and ionization of small analyte molecules. However, unlike SIMS, the PD process also results in the desorption of larger, more labile species (e.g., insulin and other protein molecules).

Additionally, lasers have been used in a similar manner to induce desorption of biological or other labile molecules. See, for example, Cotter et al. (R. B. VanBreeman, M. Snow, R. J. Cotter, *Int. J. Mass Spectrom. Ion Phys.* 49 (1983) 35; Tabet, J. C.; Cotter, R. J., Tabet, J. C., Anal. Chem. 56 (1984) 1662; or R. J. Cotter et al., *Anal. Instrument.* 16 (1987) 93). Cotter modified a CVC 2000 time-of-flight mass spectrometer for infrared laser desorption of non-volatile biomolecules, using a Tachisto (Needham, Mass.) model 215G pulsed carbon dioxide laser. The plasma or laser desorption and ionization of labile molecules relies on the deposition of little or no energy in the analyte molecules of interest.

The use of lasers to desorb and ionize labile molecules intact was enhanced by the introduction of matrix assisted laser desorption ionization (MALDI) (K. Tanaka, H. Waki, Y. Ido, S. Akita, Y. Yoshida, T. Yoshica, *Rapid Commun. Mass Spectrom.* 2 (1988) 151 and M. Karas, F. Hillenkamp, Anal. Chem. 60 (1988) 2299). In the MALDI process, an analyte is dissolved in a solid, organic matrix. Laser light of a wavelength that is absorbed by the solid matrix but not by the analyte is used to excite the sample. Thus, the matrix is excited directly by the laser, and the excited matrix sublimes into the gas phase carrying with it the analyte molecules. The analyte molecules are then ionized by proton, electron, or cation transfer from the matrix molecules to the analyte molecules. This process (i.e., MALDI) is typically used in conjunction with time-of-flight mass spectrometry (TOFMS) and can be used to measure the molecular weights of proteins in excess of 100,000 Daltons.

Further, Atmospheric Pressure Ionization (API) includes a number of ion production means and methods. Typically, analyte ions are produced from liquid solution at atmospheric pressure. One of the more widely used methods, known as electrospray ionization (ESI), was first suggested by Dole et al. (M. Dole, L. L. Mack, R. L. Hines, R. C. Mobley, L. D. Ferguson, M. B. Alice, *J. Chem. Phys.* 49, 2240, 1968). In the electrospray technique, analyte is dissolved in a liquid solution and sprayed from a needle. The spray is induced by the application of a potential difference between the needle and a counter electrode. The spray results in the formation of fine, charged droplets of solution containing analyte molecules. In the gas phase, the solvent evaporates leaving behind charged, gas phase, analyte ions. This method allows for very large ions to be formed. Ions as large as 1 MDa have been detected by ESI in conjunction with mass spectrometry (ESMS).

In addition to ESI, many other ion production methods might be used at atmospheric or elevated pressure. For example, MALDI has recently been adapted by Laiko et al. to work at atmospheric pressure (Victor Laiko and Alma Burlingame, "Atmospheric Pressure Matrix Assisted Laser Desorption", U.S. Pat. No. 5,965,884, and Atmospheric Pressure Matrix Assisted Laser Desorption Ionization, poster #1121, $4^{th}$ International Symposium on Mass Spectrometry in the Health and Life Sciences, San Francisco, Aug. 25-29, 1998) and by Standing et al. at elevated pressures (Time of Flight Mass Spectrometry of Biomolecules with Orthogonal Injection+Collisional Cooling, poster #1272, $4^{th}$ International Symposium on Mass Spectrometry in the Health and Life Sciences, San Francisco, Aug. 25-29, 1998; and Orthogonal Injection TOFMS *Anal. Chem.* 71(13), 452A (1999)). The benefit of adapting ion sources in this manner is that the ion optics (i.e., the electrode structure and operation) in the mass analyzer and mass spectral results obtained are largely independent of the ion production method used.

A mass spectrometer which uses an elevated pressure ion source like ESI always has an ion production region (wherein ions are produced) and an ion transfer region (wherein ions are transferred through differential pumping stages and into the mass analyzer). The ion production region is at an elevated pressure—most often atmospheric pressure—with respect to the analyzer. The ion production region will often include an ionization "chamber". In an ESI source, for example, liquid samples are "sprayed" into the "chamber" to form ions.

Once the ions are produced, they must be transported to the vacuum for mass analysis. Generally, mass spectrometers (MS) operate in a vacuum between $10^{-4}$ and $10^{-10}$ torr depending on the type of mass analyzer used. In order for the gas phase ions to enter the mass analyzer, they must be separated from the background gas carrying the ions and transported through the single or multiple vacuum stages.

The use of RF multipole ion guides—including quadrupole ion guides—has been shown to be an effective means of transporting ions through a vacuum system. An RF multipole ion guide is usually configured as a set of (typically 4, 6, or 8) electrically conducting rods spaced symmetrically about a central axis with the axis of each rod parallel to the central axis. The ion guide has an entrance end and an exit end. Ions are generally intended to travel from the entrance to the exit end of the ion guide along the above mentioned central axis. An RF potential is applied between the rods of the ion guide so as to confine the ions radially with the ion guide. Through a combination of the ions' initial kinetic energy on entering the ion guide, a flow of gas moving along the ion guide axis, Coulombic repulsion from other ions in the ion guide, and diffusion of ions along the axis, the ions move along the central axis from the entrance end to the exit end.

Publications by Olivers et al. (Anal. Chem, Vol. 59, p. 1230-1232, 1987), Smith et al. (Anal. Chem. Vol. 60, p. 436-441, 1988) and Douglas et al. U.S. Pat. No. 4,963,736 (incorporated herein by reference) have reported the use of RF-only quadrupole ion guides (i.e. having four rods) to transportions from an API source to a mass analyzer. Moreover, a quadrupole ion guide capable of being operated in RF only mode configured to transportions is also described by Douglas.

Such multipole ion guides may be configured as collision cells capable of being operated in RF only mode with a variable DC offset potential applied to all rods. Thomson et al., U.S. Pat. No. 5,847,386 (incorporated herein by reference) also describes a quadrupole ion guide. The ion guide of Thomson is configured to create a DC axial field along its axis to move ions axially through a collision cell, inter alia, or to promote dissociation of ions (i.e., by Collision Induced Dissociation (CID)).

Other schemes are available utilizing both RF and DC potentials in order to facilitate the transmission of ions of a certain range of m/z values. For example, in H. R. Morris et al., High Sensitivity Collisionally Activated Decomposition Tandem Mass Spectrometry on a Novel Quadrupole/Orthogonal Acceleration Time-of-Flight Mass Spectrometer, *Rapid Commun. Mass Spectrom.* 10, 889 (1996)(Morris), uses a series of multipoles in their design, one of which is a quadrupole which is capable of being operated in a "wide bandpass" mode or a "narrow bandpass" mode. In the wide bandpass mode, an RF-only potential is applied to the quadrupole and ions of a relatively broad range of m/z values are transmitted. In narrow bandpass mode both RF and DC potentials are applied between the rods of the quadrupole such that ions of only a narrow range of m/z values are selected for transmission through the quadrupole. In subsequent multipoles the selected ions may be activated towards dissociation. In this way the instrument of Morris is able to perform MS/MS with the first mass analysis and subsequent fragmentation occurring in what would otherwise be simply a set of multipole ion guides.

Further, mass spectrometers similar to that of Whitehouse et al. U.S. Pat. No. 5,652,427, entitled "Multipole Ion Guide for Mass Spectrometry", (incorporated herein by reference) use multipole RF ion guides to transfer ions from one pressure region to another in a differentially pumped system. In the source of Whitehouse, ions are produced by ESI or APCI at substantially atmospheric pressure. These ions are transferred from atmospheric pressure to a first differential pumping region by the gas flow through a glass capillary. Ions are transferred from this first pumping region to a second pumping region through a "skimmer" by an electric field between these regions as well as gas flow. A multipole in the second differentially pumped region accepts ions of a selected mass/charge (m/z) ratio and guides them through a restriction and into a third differentially pumped region. This is accomplished by applying AC and DC voltages to the individual poles.

However, the above multipole ion guides all require that the rods of which they are constructed not be electrically connected to adjacent rods. In order to avoid discharges between adjacent rods, electrically insulating holders are frequently used to hold the rods in their proper places within the assembly. To further avoid arcing between adjacent rods along the surface of the insulating holder, the holder typically has a slot, groove, or similar cutout in the holder between adjacent rods. The insulating holder must not be exposed to the ion beam that is passing through the multipole because ions which fall onto the insulator will leave a charge on the surface of the holder. As the surface of the holder charges up, from the ions depositing charge there, an electrical potential will build up on the holder surface and project a field into the interior of the assembly. The field from a charged holder surface may disturb or prevent the progress of ions through the ion guide.

In the above multipole according to Whitehouse, the insulating holder and mounting brackets act also as the pumping restriction, however, the requirement to isolate adjacent rods from one another and to avoid exposing the holder surface to the ion beam means that the inner diameter of the holder must be substantially larger than the inscribed diameter of the multipole. As a result, the gas conductance is relatively high as compared to an aperture having the same diameter as the inscribed diameter of the multipole.

Park discloses a multiple frequency multipole ion guide in U.S. Pat. No. 6,911,650 (incorporated herein by reference). According to Park, the multiple frequency multipole ion guide " . . . can guide ions of a broad range of m/z through a pumping region to an analyzer. To accomplish this, a multitude of electrodes is used to . . . [construct] the ion guide. The ion guide is "driven" by a complex RF potential consisting of at least two frequency components. The potential is applied between the electrodes of the multipole in such a way that a low frequency RF field appears only near the boundaries of the multipole whereas a higher frequency field appears throughout the device. The high frequency field forces low m/z ions towards the center of the guide whereas the low frequency component of the field reflects high m/z ions toward the guide's interior, at the boundary of the ion guide." The ion guide according to Park has a mass transmission range of a factor of about 3,000—i.e. about 30 times that of a hexapole ion guide.

Importantly, the ion guide according to Park does not confine ions solely by the action of the RF fields. Rather, a set of DC electrodes is required in order to reflect ions at the gap between "virtual poles". This complicates the construction and operation of the multipole.

Many different types of analyzers have been used to mass analyze sample ions. One important type of mass analyzer is the quadrupole mass analyzer. There are also several types of quadrupole analyzers. Among them are the quadrupole filter, the quadrupole trap—a.k.a. the Paul trap—the cylindrical ion trap, linear ion trap, and the rectilinear ion trap.

The conventional quadrupole filter consists of four rods equally spaced at a predetermined radius around a central axis. A radio frequency (RF)—e.g. a 1 MHz sine wave—potential is applied between the rods. The potential on adjacent rods is 180° out of phase. Rods on opposite sides of the quadrupole axis are electrically connected—i.e. the quadrupole is formed as two pairs of rods. The quadrupole has an entrance end and an exit end. Ions to be filtered are injected into the entrance end of the quadrupole. These ions travel along the axis of the quadrupole to the exit end. The RF potential applied between the rods will tend to confine the ions radially. The quadrupole may be used as an ion guide when only the RF potential is applied. Ions of a broad m/z range may thereby be transmitted from the entrance to the exit end along the central axis. However, applying a DC as well as an RF potential between the pairs of rods will cause ions of only a limited mass range to be transmitted through the quadrupole. Ions outside this mass range will be filtered away and will not reach the exit end.

In a quadrupole mass spectrometer, ions transmitted through the quadrupole may be detected as ion signals via, for example, a channeltron detector. To produce a mass spectrum the quadrupole parameters are "scanned" and the ion signals are recorded as a function of the scan parameters. In the so-called "mass-selective stability" mode of operation the amplitudes of RF and DC voltages applied to the quadrupole rods are ramped at a constant RF/DC ratio. At each point in the ramp, ions of nominally a single m/z have a stable trajectory and are transmitted. Recording the ion signal as a function of the ramp thus yields a mass spectrum.

While in a quadrupole, ions will oscillate about the central axis with a resonant secular frequency. The resonant frequency of motion is dependent on the m/z of the ion and the amplitude and frequency of the RF waveform applied between the rods. As a result, ions of a selected m/z may be excited—that is the amplitude of the ion's oscillation about the central axis may be increased—by applying an additional AC waveform between the rods at the resonant frequency of the selected ions. If the amplitude of the ions' oscillations is increased enough, they will be ejected from the quadrupole.

A method taking advantage of this method of exciting ions' oscillations is described by Belov et al. in U.S. Pat. No. 6,787,760 (incorporated herein by reference). According to an example of the method disclosed by Belov, "non-selective ion trapping in [an] accumulation quadrupole occurs for a short period. Signal acquisition is performed using both an Odyssey data station and a 12-bit ADC coupled to a PC running ICR-2LS software available at the Pacific Northwest National Laboratory. Mass spectra acquired with the PC are converted to secular frequency spectra of ion oscillation in the selection quadrupole and a superposition of the sine auxiliary RF waveforms is applied to the selection quadrupole rods. Selective ion trapping in the accumulation quadrupole occurs for a period longer than that used in the non-selective accumulation. During the selective accumulation the most abundant ion species determined from the previous spectrum are ejected from the selection quadrupole prior to external accumulation. The combined information from the two mass spectra provides information over a much wider dynamic range than would be afforded by either spectrum alone."

However, the electric field used to excite the ions in prior art quadrupoles is heterogeneous. That is, ions at different locations in the quadrupole will experience a different excitation electric field strength. While this has a limited impact on the method described by Belov, it nonetheless may have an impact in the more general case. In general it is desirable to have a homogeneous excitation field wherein all ions of a given m/z are excited in the same way regardless of their position in the quadrupole.

As stated by Sakudo and Hayashi (N Sakudo and T. Hayashi, *Rev. Sci. Instrum.* 46(8), p. 1060 (1975).) "Quadrupole electrodes in mass filters and strong focusing lenses have usually been constructed in the form of circular rods or split circular concaves because of the difficulty of making ideal hyperbolic electrodes and aligning them in correct positions. Compared with these, quadrupole electrodes with flat faces are very easy to assemble in precisely symmetric positions due to the mechanical simplicity of spacing insulators." Rectangular cross section rods being easier to manufacture and assemble, are advantageous especially when constructing miniature quadrupole filters. Such miniature quadrupole filters are useful when filtering or mass analyzing ions at elevated pressures—i.e. at pressures greater than about $10^4$ mbar—or as part of portable instruments.

However, these so called "rectilinear" quadrupoles have the disadvantage that the electrodynamic fields in such devices deviate substantially from the ideal quadrupole field. As a result, the mass resolving power of such devices is much lower than that of other comparable prior art quadrupole filters.

SUMMARY

In accordance with one embodiment of the invention, a multipole is composed of a set of electrode structures arranged rectilinearly and symmetrically about a central axis and electrically connected so as to form an abridged multipole field when a proper potential is applied between the electrodes. The electrode structures are extended parallel to the central axis, however, when the multipole is viewed in cross section, the electrode structures are each comprised of a plurality of electrodes arranged along a multitude of stacked lines, symmetrically about the central axis. An RF potential is applied between the electrodes and within a given line of electrodes, the potential applied to the electrodes is a linear function of the position of the electrode along the line. The abridged RF multipole field thus formed focuses ions toward the central axis and thereby guides ions from an entrance end of the abridged multipole to its exit end.

In alternate embodiments, the electrodes arranged along a given line are connected via a series of resistors and/or capacitors of substantially equal resistance and capacitance respectively.

In further alternate embodiments, the RF potential is applied only at the intersections of the lines of electrodes and from there is divided via the RC network among the electrodes.

In still further alternate embodiments, the electrodes and/or the resistive and/or the capacitive components are formed by the deposition of resistive and/or conductive material on insulating rectilinear rods or plates. In other alternate embodiments, the insulating rods or plates are comprised of macor or ceramic. In further alternate embodiments, the electrodes deposited on the insulating plates are electrically connected and adjacent plates are simultaneously mechanically connected via a thin film of solder paste.

In accordance with another embodiment of the invention, a multipole is constructed according to the embodiments set forth above so that, when the multipole is viewed in cross section, the electrodes are arranged along four lines positioned symmetrically about the central axis and form a rectangle.

In accordance with one embodiment of the invention, a method is provided whereby a homogeneous electrostatic field is generated within an abridged quadrupole wherein the DC potentials are applied only at the intersections of the lines of electrodes and from there is divided via an RC network among the electrodes. A first DC potential is applied to adjacent intersections—i.e. to opposite ends of one line of electrodes—and a second DC potential is applied to the remaining two intersections—i.e. to the opposite ends of a second line of electrodes parallel to but on the opposite side of the central axis from the first set of electrodes. The electrodes in the first line of electrodes will all have the first DC potential. The electrodes in the second line of electrodes will all have the second DC potential. The potentials on the electrodes of the remaining two lines of electrodes will be governed by the RC network connecting the electrodes to the first and second lines of electrodes. Given that the RC network comprises resistors all having the same resistance and capacitors all having the same capacitance, the potential difference between the first and second DC potentials will be divided evenly between the electrodes of the remaining two lines of electrodes and the electric field formed in the abridged quadrupole will therefore be uniform. That is, unlike prior art quadrupoles, the DC field in the abridged quadrupole can be formed homogeneously such that the force exerted on ions via the DC field is not a function of the position of the ion in the abridged quadrupole. With the application of the appropriate DC potentials at the intersections of the lines of electrodes, a uniform electrostatic field having field lines of any desired magnitude pointing in any desired direction orthogonal to the central axis can be formed.

The application of such a uniform DC field effectively shifts the axis about which ions will oscillate when passing through the abridged quadrupole. Higher m/z ions will tend to oscillate about an axis further from the central axis than lower m/z ions when the DC field is applied.

In accordance with a further embodiment of the invention, a method is provided whereby a homogeneous electrodynamic field is generated within an abridged quadrupole according to the present invention wherein AC potentials are applied only at the intersections of the lines of electrodes and from there is divided via an RC network among the electrodes. A first AC potential is applied to adjacent intersections—i.e. to opposite ends of one line of electrodes—and a second AC potential is applied to the remaining two intersections—i.e. to the opposite ends of a second line of electrodes parallel to but on the opposite side of the central axis from the first set of electrodes. The electrodes in the first line of electrodes will all have the first AC potential. The electrodes in the second line of electrodes will all have the second AC potential. The potentials on the electrodes of the remaining two lines of electrodes will be governed by the RC network connecting the electrodes to the first and second lines of electrodes. Given that the RC network comprises resistors all having the same resistance and capacitors all having the same capacitance, the potential difference between the first and second AC potentials will be divided evenly between the electrodes of the remaining two lines of electrodes and the electric field formed in the abridged quadrupole will therefore be uniform. That is, unlike prior art quadrupoles, the AC field in the abridged quadrupole can be formed homogeneously such that the force exerted on ions via the AC field is not a function of the position of the ion in the abridged quadrupole. With the application of the appropriate AC potentials at the intersections of the lines of electrodes, a uniform electrostatic field having field lines of any desired magnitude pointing in any desired direction orthogonal to the central axis can be formed. With the application of the appropriate AC potentials at the intersections of the lines of electrodes, a rotating uniform electric field having field lines of any desired magnitude rotating in a plane orthogonal to the central axis can be formed. By applying the AC potentials at a predetermined frequency or set of frequencies, the AC field may be used to resonantly excite ions of one or more selected m/z's or m/z ranges.

In accordance with a further embodiment of the invention, an apparatus and method are provided for a multipole composed of a set of electrodes arranged rectilinearly and symmetrically about a central axis and electrically connected so as to form a multiple frequency multipole field when a proper potential is applied between the electrodes. The electrodes are extended parallel to the central axis; however, when the multipole is viewed in cross section, the electrodes are arranged along four lines, symmetrically about the central axis and form a rectangle. An RF potential is applied between the electrodes. Within a given line of electrodes, the potential applied to the electrodes is a function of time and the position of the electrode along the line. This function takes the form of $$\Phi(y, t) = \sum_{i=1}^{j} g_i(y) h_i(t)$$

where y is electrode position, g(y) is a periodic function of position, and h(t) is a periodic function of time. The abridged RF multiple frequency multipole field thus formed focuses ions toward the central axis and thereby guides ions from an entrance end of the abridged RF multiple frequency multipole to its exit end. The effect of applying a potential of this form to the electrodes is to produce an RF field having a substantially multipole—for example, quadrupolar—nature near the central axis and having a significant dipolar nature near the electrodes. The quadrupolar component of the field will tend to confine lower m/z ions to the central axis whereas the higher m/z ions approaching the electrodes will be reflected towards the central axis by the lower frequency dipole field. Unlike prior art multiple frequency multipoles, ions are confined solely by the action of the RF fields. No DC trapping electrodes are required to reflect high m/z ions at the gap between electrodes.

In alternate embodiment methods, the amplitude of the dipole waveform may be set arbitrarily close to zero. Further, a destabilizing DC potential may be applied to the electrodes so as to filter ions in a manner analogous to prior art quadrupole filters. Further, mass spectra may be obtained by scanning the amplitude of the quadrupolar waveform together with the destabilizing DC and recording the intensity of the transmitted ion beam as a function of the waveform amplitude. In further alternate embodiments, the electrodes and/or resistive and/or capacitive components comprising the abridged multiple frequency multipole are formed by the deposition of resistive and/or conductive material on insulating rectilinear rods or plates. In further alternate embodiments, the insulating rods or plates are comprised of macor or ceramic. In further alternate embodiments, the electrodes deposited on the insulating plates are electrically connected and adjacent plates are simultaneously mechanically connected via a thin film of solder paste.

In accordance with a further embodiment of the invention, a method is provided whereby ions are filtered by mass selective stability within an abridged quadrupole. According to this method, RF and DC potentials are applied only at the intersections of the lines of electrodes and from there are divided via an RC network among the electrodes. To form the abridged RF quadrupolar field an RF potential is applied between adjacent intersections. That is, at any given intersection, an RF potential is applied. The same RF potential, but 180° out of phase, is applied at adjacent intersections. Similarly, the destabilizing DC field is formed by applying a DC potential between adjacent intersections. At any given intersection, a DC potential is applied. The same magnitude DC potential but of opposite polarity is applied at adjacent intersections. Ions of a single m/z or narrow range of m/z will be stable in an abridged quadrupole when an RF of a given frequency and amplitude and a DC of a given amplitude are applied. The trajectories of other ions will be unstable and these ions will be ejected radially from the abridged quadrupole or will collide with the electrodes. Mass spectra may be obtained by scanning the amplitude of the RF waveform together with the destabilizing DC and recording the intensity of the transmitted ion beam as a function of the waveform amplitude. In an alternate embodiment, gaps may be left in the array of electrodes in the locations where the lines of electrodes would otherwise intersect. Under appropriate conditions, all or some fraction of the ions destabilized by the combination of the RF and DC potentials will be ejected through the gaps left at the intersections of the lines of electrodes. Ions of low m/z will be ejected through two gaps on opposing sides of the abridged quadrupole. Ions of high m/z will be ejected in a direction orthogonal to the low m/z ions, through the two remaining gaps. Ejected ions may be detected via an ion detector or recaptured via another ion optical device for further analysis. In further alternate embodiments, the electrodes and/or resistive and/or capacitive components comprising the abridged quadrupole are formed by the deposition of resistive and/or conductive material on insulating rectilinear rods or plates. In further alternate embodiments, the insulating rods or plates are comprised of macor or ceramic. In further alternate embodiments, the electrodes deposited on the insulating plates are electrically connected and adjacent plates are simultaneously mechanically connected via a thin film of solder paste.

In accordance with a further embodiment of the invention, an apparatus and method are provided for a multipole composed of a set of electrodes arranged rectilinearly and symmetrically about a central axis and electrically connected so as to form an abridged quadrupole field when a proper potential is applied between the electrodes. The electrodes are extended parallel to the central axis, however, when the multipole is viewed in cross section, the electrodes are arranged along two parallel lines, on opposite sides of, and equidistant from, the central axis. The extent of the lines of electrodes is preferably greater than the distance between the central axis and the lines of electrodes at their closest approach. An RF potential is applied between the electrodes. Within a given line of electrodes, the potential applied to the electrodes is a linear function of the position of the electrode along the line. The abridged RF quadrupole field thus formed focuses ions toward the central axis and thereby guides ions from an entrance end of the abridged quadrupole to its exit end. In alternate embodiments, the electrodes arranged along a given line are connected via a series of resistors and/or capacitors of substantially equal resistance and capacitance respectively. In further alternate embodiments, the RF potential is applied only at the extents of the lines of electrodes and from there is divided via the RC network among the electrodes. In further alternate embodiments, the electrodes and/or the resistive and/or the capacitive components are formed by the deposition of resistive and/or conductive material on insulating rectilinear rods or plates. In further alternate embodiments, the insulating rods or plates are comprised of macor or ceramic. In further alternate embodiments, the electrodes deposited on the insulating plates are electrically connected and adjacent plates are simultaneously mechanically connected via a thin film of solder paste. In alternate embodiment methods, a destabilizing DC potential may be applied to the electrodes so as to filter ions in a manner analogous to prior art quadrupole filters. Further, mass spectra may be obtained by scanning the amplitude of the RF waveform together with the destabilizing DC and recording the intensity of the transmitted ion beam as a function of the waveform amplitude. In further embodiments, a homogeneous electrostatic field may be formed by applying appropriate DC potentials at the extents of the lines of electrodes. In further embodiments, a supplemental AC potential may be applied to the abridged quadrupole in order to excite ions of selected m/z ratios or ranges of m/z ratios. In one embodiment, the AC potential is applied so as to excite ions in a direction parallel to the lines of electrodes. Sufficiently excited ions may be ejected from the abridged quadrupole in a direction parallel to the line of electrodes and without the ion colliding with an electrode. In further alternate embodiments, the two parallel lines of electrodes are positioned arbitrarily close to each other so as to form a substantially one dimensional abridged quadrupolar field. That is, the field of the abridged quadrupole according to such an embodiment is quadrupolar in nature in two dimensions, but has a significantly greater extent in one dimension—i.e. parallel to the lines of electrodes—than the other—i.e. perpendicular to the line of electrodes. In further embodiments, the two parallel lines of electrodes are brought sufficiently close to one another—i.e. about 1 mm or less—so as to form a miniature abridged quadrupole. In further alternate embodiments, by appropriate connections between electrodes within each of the two lines of electrodes, an array of miniature abridged quadrupoles is formed.

According to another embodiment, an apparatus and method are provided for guiding ions between pumping stages. An abridged multipole, together with its electrically insulating support and electrodes either deposited on or positioned in between insulating layers, acts as a restriction between pumping stages. The abridged multipole has an entrance end in one pumping stage and an exit end in a second pumping stage. Ions are guided from the entrance end in the first pumping stage to the exit end in the second pumping stage via the confining RF field of the multipole. The abridged multipole may be any length along the central axis. In alternate embodiments, the abridged multipole is arbitrarily short and thus takes the form of a plate with an aperture in it. Unlike prior art multipoles, an abridged multipole according to the present invention does not require large slots between the electrodes in the insulating support and therefore can form a superior pumping restriction. Furthermore, an abridged multipole according to the present invention can more readily be constructed with a small inscribed diameter than prior art multipoles. In alternate embodiments the abridged multipole may have a different inscribed diameter at the entrance end than at the exit end. For example, the abridged multipole may have a larger inscribed diameter at the entrance end than at the exit end. This may allow the abridged multipole to collect ions efficiently at the entrance end and focus them down to a tighter beam at the exit end.

According to another embodiment, an apparatus and method are provided for a mass spectrometer comprising at least a source of ions wherein analyte material is formed into ions, an abridged multipole for guiding and/or analyzing ions, and a detector with which ions may be detected. The abridged multipole may be an abridged quadrupole and may be used to filter ions and, by scanning, may be used to produce a mass spectrum. The mass spectrometer may include more than one abridged multipole, said multipoles performing a multitude of functions including guiding ions within or between pumping stages, selecting ions according to their m/z, acting as a collision cell, transmitting ions to downstream analyzers. Alternatively, the mass spectrometer may be a hybrid instrument including an orthogonal TOF analyzer, an FTICR mass analyzer, a prior art quadrupole filter, a quadrupole trap, a linear ion trap, an orbitrap, or any other known mass analyzer. The abridged multipole according to the present invention may be used in conjunction with prior art analyzers to accomplish any combination of tandem ion mobility—mass spectrometry or tandem mass spectrometry experiments known in the prior art in any desired order.

BRIEF DESCRIPTION OF THE DRAWINGS

For a more complete understanding of the present invention, reference is now made to the following drawings in which.

DETAILED DESCRIPTION

While the invention has been shown and described with reference to a number of embodiments thereof, it will be recognized by those skilled in the art that various changes in form and detail may be made herein without departing from the spirit and scope of the invention as defined by the appended claims.

As discussed above, the present invention relates generally to the mass spectroscopic analysis of chemical samples and more particularly to mass spectrometry. Specifically, an apparatus and method are described for the transport and mass spectrometric analysis of analyte ions. Reference is herein made to the figures, wherein the numerals representing particular parts are consistently used throughout the figures and accompanying discussion.

Prior art quadrupoles are typically comprised of four electrically conducting rods placed symmetrically about a central axis. It is well known that the equation for an ideal quadrupolar field formed in such a device can be expressed as:

$$\Phi(t) = \frac{\Phi_o(t)\cdot(x'^2 - y'^2)}{2r_o'^2} \tag{1}$$

where $\Phi(t)$ is the potential at point (x', y'), $\Phi_o(t)$ is the potential between the electrodes defining the field, and $2r'_o$ is the minimum distance between opposite electrodes.

In an ideal construction, the surfaces of the electrodes fall on equipotential lines of the quadrupole field. That is, the surfaces of the electrodes fall on hyperbolic curves defined by:

$$x'^2=r'^2_o+y^2 \tag{2}$$

In this construction the electrodes, i.e. the rods, are extended parallel to the z-axis, the z-axis is orthogonal to the x'-y' plane, the z-axis is the central axis of the device and the potential applied between the electrodes, $\Phi_o(t)$, is a function of time. It is well-known that the so-called "pseudopotential" well produced via such a quadrupolar field is cylindrically symmetric. Surprisingly, the present inventor has discovered that specific lines can be chosen within a quadrupolar field such that, along these lines, the change of the potential, $\Phi(t)$, is a linear function of position.

To demonstrate this, assume that y' is a linear function of x'. That is:

$$y'=mx'+b, \tag{3}$$

where m is the slope of the selected line and b is the y'-intercept. Then equation (1) becomes:

$$\Phi(t)=\frac{\Phi_o(t)\cdot(x'^2-(mx'+b)^2)}{2r'^2_o} \tag{4}$$

or, expanding $$\Phi(t)=\frac{\Phi_o(t)\cdot(x'^2-m^2x'^2-2mx'b-b^2)}{2r'^2_o} \tag{5}$$

If m=+/−1 then:

$$\Phi(t)=\frac{-\Phi_o(t)\cdot(2mx'b+b^2)}{2r'^2_o} \tag{6}$$

which clearly is a linear function of x'. The implication is that a quadrupolar field may be produced using a rectilinear array of electrodes spaced at intervals along lines selected in accordance with equation (3) and having applied thereto potentials having a linear variation as a function of position in accordance with equation (6).

Figure 1A:
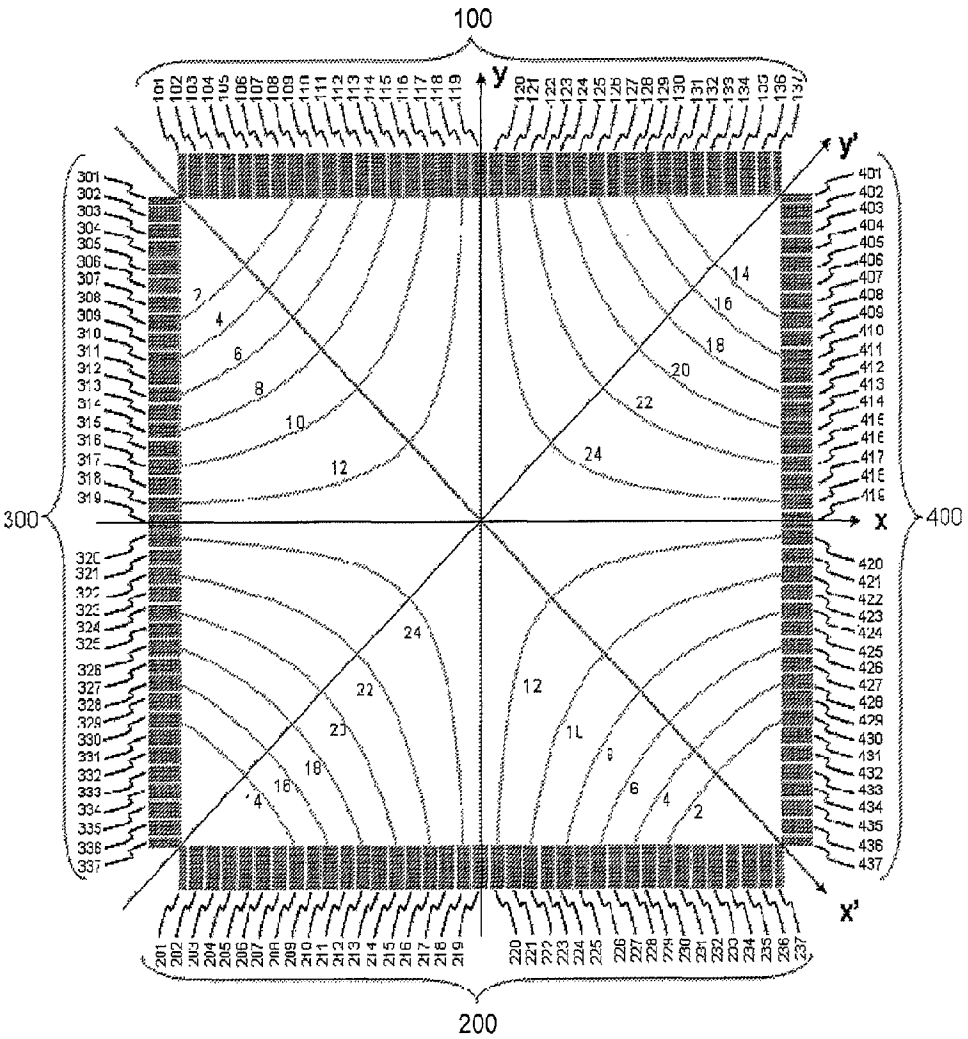
FIG. 1A is a cross-sectional view of an abridged quadrupole according to the present invention and equipotential lines calculated to be formed during operation.

FIG. 1A depicts a cross sectional view of an abridged quadrupole 1 constructed according to the present invention. Here the y'-intercept, b, has been chosen to equal $+/-r'_o$. In this case, equation (6) reduces to:

$$\Phi(t)=-\Phi_o(t)(½+x'/r'_o) \text{ for } -r_o'\le x'\le 0; \text{ and} \tag{7a}$$

$$\Phi(t)=-\Phi_o(t)(½-x'/r'_o) \text{ for } 0\le x'\le r_o'. \tag{7b}$$

For convenience, new axes, x and y, are defined in FIG. 1 rotated 45 degrees from the x', y' coordinate system. In this new coordinate system:

$$\Phi(t)=\frac{-\Phi_o(t)\cdot x\cdot y}{2r_o^2} \tag{8}$$

and the inner surfaces of electrode set 100—comprised of electrodes 101 through 137—and electrode set 200—comprised of electrodes 201 through 237—fall on the lines:

$$y=+/-r_o, \tag{9}$$

whereas those of electrodes set 300 and 400—comprised of electrodes 301-337 and 401-437 respectively—fall on the lines:

$$x=+/-r_o. \tag{10}$$

These lines, and therefore electrode sets 100, 200, 300, and 400, are placed symmetrically about the central axis—i.e. the z-axis—and electrodes 101-137, 201-237, 301-337, and 401-437 are extended parallel to the z-axis—i.e. into the page—for the length of the device. Also, whereas $2r'_o$ is the minimum distance between opposite electrodes along the x' or y' axes, $2r_o$ is the minimum distance between opposite electrodes along the x or y axes. It should be understood that a wide range of dimensions may be chosen for abridged quadrupole 1 of the present invention, however, in the example depicted in FIG. 1, $r_o$ was chosen to be 1.8 mm. Each electrode 102-136, 202-236, 302-336, and 402-436 is 0.08 mm wide. Electrodes 101, 137, 201, 237, 301, 337, 401, and 437 are 0.04 mm wide. The gap separating adjacent electrodes 101-137, 201-237, 301-337, and 401-437 is 0.02 mm wide. Thus, the center-to-center distance between adjacent electrodes 101-137, 201-237, 301-337, and 401-437 is 0.1 mm.

It should be understood that a wide range of potentials may be applied between the electrodes of abridged quadrupole 1, however, as an example, $\Phi_o(t)$ is chosen here to equal 360V. For any given electrode set 100, 200, 300, or 400, the potential $\Phi_o(t)$ is applied across the electrode set. Thus, in accordance with equation (8), the potential applied to electrodes 137, 401, 201, and 337 equals $-\Phi_o(t)/2$ which is −180V. Similarly, +180V is applied to electrodes 101, 301, 437, and 237. The potentials on remaining electrodes 102-136, 202-236, 302-336, and 402-436 bear a linear relationship to the positions of the electrodes in abridged quadrupole 1 in accordance with equation (8). For example, electrodes 119, 120, 121, and 122 have applied to them 0V, −10y, −20V, and −30V, respectively.

Given the potentials, placement, and widths of electrodes 101-137, 201-237, 301-337, and 401-437, as described above, it is possible to calculate the equipotential curves, 2-24, of the resultant electric field as shown in FIG. 1A. The equipotential curves of FIG. 1A were calculated using Simion 7.0 (Scientific Instrument Services, Inc., Ringoes N.J.). Curves 2, 4, 6, 8, 10, and 12, represent equipotentials of 110V, 90V, 70V, 50V, 30V, and 10V respectively. Similarly, curves, 14, 16, 18, 20, 22, and 24 represent equipotentials of −110V, −90V, −70V, −50V, −30V, and −10V respectively. By visual inspection and as defined via equation (8) equipotential curves 2-24 are hyperbolic. As expected, the electric field is "quadrupolar" in nature.

Figure 1B:
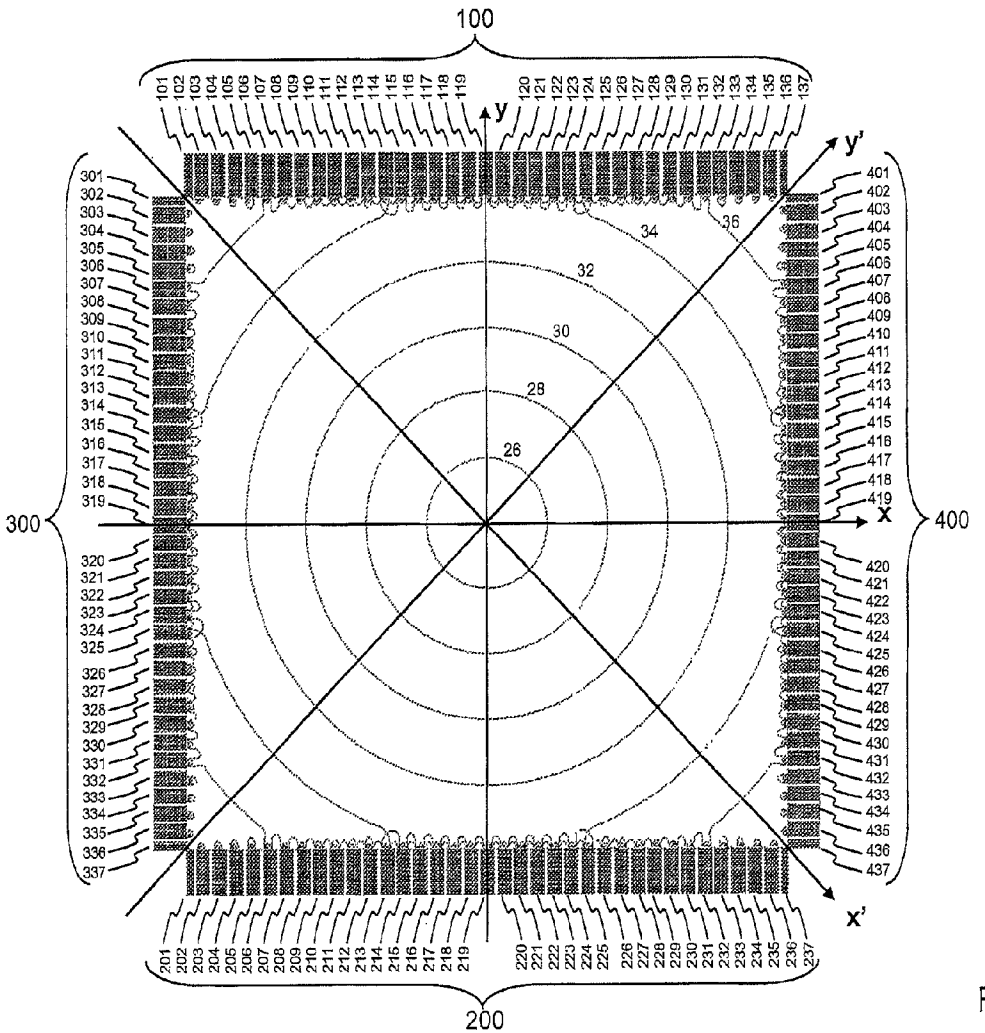
FIG. 1B is a cross-sectional view of an abridged quadrupole according to the present invention and equiqradient lines calculated to be formed during operation.

The quadrupolar nature of the electric field formed this way is further demonstrated in FIG. 1B. In FIG. 1B, equigradient curves, 26-36 are plotted. As calculated using Simion, curves 26, 28, 30, 32, 34, and 36 represent equigradients 20V/mm, 40V/mm, 60V/mm, 80V/mm, 100V/mm, and 120V/mm. While equigradient curves 26-36 do not represent "pseudopotentials" directly, they do demonstrate a cylindrical symmetry just as the equigradient curves of a quadrupolar electric field should have and as a quadrupolar pseudopotential well should have. Interestingly, the cylindrical symmetry of the equigradient curves is maintained throughout abridged quadrupole 1 except in regions close to electrodes 101-137, 201-237, 301-337, and 401-437—i.e. closer than about the center-to-center spacing between the electrodes. The equipotential curves 2-24 and equigradient curves 26-36 indicate that a near ideal quadrupolar field can be formed in abridged quadrupole 1.

Potentials may be applied to electrode sets 100, 200, 300, and 400 via any known prior art method. However, as an example, potentials from a driver may be applied directly to electrodes at the corners of abridged quadrupole 1—i.e. where the electrode sets intersect. That is, the potential $\Phi_o(t)/2$ may be applied directly to electrodes 237, 437, 101, and 301 and the potential $-\Phi_o(t)/2$ may be applied to electrodes 201, 401, 137, and 337. From these electrodes—i.e. electrodes 101, 201, 301, 401, 137, 237, 337, and 437—the potentials are divided by known prior art methods and applied to remaining electrodes, 102-136, 202-236, 302-336, and 402-436. The voltage divider may be comprised of a resistor divider and/or a capacitor divider and/or an inductive divider. As an example, if a capacitor divider is used, a series of capacitors—one between each of electrodes 101-137, one between each of electrodes 201-237, one between each of electrodes 301-337, and one between each of electrode 401-437—would divide the potentials $\Phi_o(t)/2$ and $-\Phi_o(t)/2$ among the electrodes. Each capacitor used in the divider would have the same capacitive value. The capacitance of the individual capacitors must be chosen to be much higher than the capacitance between electrodes of opposite polarity—for example, that between electrode 413 and all of electrodes 101-119, 301-319, 420-437, and 220-237—and must be substantially higher than the capacitance between an individual electrode and nearby conductors—e.g. conductive supports or housing. However, the capacitance of the individual component should be chosen to be low enough so as not to overload the driver.

It is preferable to use a resistor divider in combination with the above described capacitor divider. Some of the ions passing through abridged quadrupole 1 will strike the electrodes. When this occurs, the charge deposited on the electrode by the ion must be conducted away. One way this may be readily accomplished is via a resistor divider. Like the above described capacitor divider, the resistor divider consists of a series of resistors—one between each of electrodes 101-137, one between each of electrodes 201-237, one between each of electrodes 301-337, and one between each of electrodes 401-437—which, together with the capacitor divider, divides the potentials $\Phi_o(t)/2$ and $-\Phi_o(t)/2$ among the electrodes. Each resistor used in the divider has the same resistance value so that the potentials are divided linearly amongst the electrodes in accordance with equation (8). The resistance of the individual resistors must be chosen to be low enough that charge can be conducted away at a much higher rate than it is deposited on the electrode by the ions. However, the resistance of the individual component must be chosen to be high enough so as not to overload the driver. In principle, a resistor divider may be used alone—without a capacitor divider—if the values of the resistors are sufficiently low that the current through the resistors can charge the electrodes at the desired RF frequency and if such low resistance values do not overload the driver.

Any appropriate prior art electronics may be used to drive the abridged quadrupole according to the present invention. However, as an example, a resonantly tuned LC circuit might be used to provide potentials to abridged quadrupole 1. In one embodiment, a waveform generator drives a current through the primary coil of a step-up transformer. The secondary coil is connected on one end to electrodes 101, 301, 237, and 437 and on the other to electrodes 201, 337, 401, and 137. The potential, $\Phi_o(t)$, produced across the secondary coil is divided among electrodes 102-136, 202-36, 302-336, and 402-436 by, for example, a capacitor divider as described above. In such a resonant LC circuit the waveform will be sinusoidal. The inductance of the secondary coil and the total capacitance of the divider and electrodes will determine the resonant frequency of the circuit. The capacitance and inductance of the system is therefore adjusted to achieve the desired frequency waveform as is well known in the prior art.

In alternate embodiments, each electrode in sets 100, 200, 300, and 400 is electrically connected directly to the above mentioned secondary coil. According to this embodiment, the secondary coil is comprised of a winding wire that is looped around a core—i.e. a cylindrically shaped support—a multitude of times in a helical fashion. For example, the wire may be looped around the core 36 times. During operation, the potential $\Phi_o(t)$ is induced across the length of the secondary coil via the oscillating current in the primary coil. The potential at any given point along the secondary coil is a linear function of position along the coil. Thus, the potential difference between one end of the secondary coil and the first loop is $\Phi_o(t)/36$. Likewise, the potential difference between the end of the secondary coil and the second loop is $\Phi_o(t)/18$. And between the end of the coil and loop, n, the potential difference is $n\,\Phi_o(t)/36$. Thus, according to this embodiment, electrode 101 is connected to one end of the secondary coil, and electrodes 102-137 are electrically connected to the first through the thirty sixth loop respectively—each successive electrode connected to each successive loop in the coil. Notice that the thirty sixth loop is actually equivalent to the opposite end of the secondary coil. A DC potential may be applied to the secondary coil and thereby to the electrodes of sets 100, 200, 300, and 400 of abridged quadrupole 1 by methods well known in the prior art.

When any of the embodiments discussed above is operated as an ion guide or as a quadrupole mass filter, electrodes 101, 301, 237, and 437 will always be at the same potential and therefore may be directly connected to each other. Similarly, for any of the other electrodes in sets 100, 200, 300, and 400 there are three other electrodes in abridged quadrupole 1 which will always be at the same potential and therefore may be electrically connected to each other.

The potential, $\Phi_o(t)$, applied to abridged quadrupole 1 may be any of a wide variety of functions of time, however, as an example, it may be given by:

$$\Phi_o(t)=V\sin(2\pi ft)+U, \tag{11}$$

where V is the zero-to-peak RF voltage applied between opposite ends of each electrode set 100, 200, 300, and 400, f is the frequency of the waveform in Hertz, and U is a DC voltage applied between opposite ends of each electrode set 100, 200, 300, and 400. In alternate embodiments, $\Phi_o(t)$ may be a triangle wave, square wave, or any other function of time. If the DC voltage, U, is selected to be zero volts, then abridged quadrupole 1 will act as a simple ion guide.

As mentioned above, electrode sets 100, 200, 300, and 400 are extended parallel to a central, z-axis which is orthogonal to the x-y plane. In the preferred embodiment, electrode sets 100, 200, 300, and 400 all originate at the same coordinate along the z-axis and are all of the same length. Abridged quadrupole 1 therefore, is extended along the z-axis and has two ends through which ions may enter and exit. Abridged quadrupole 1 may be any length along the z-axis, however, as an example, quadrupole 1 may be 10 cm long. In one embodiment, ions enter through one end of abridged quadrupole 1, along its central axis—i.e. the z-axis. Ions are preferably injected near the central axis—i.e. near the origin of the x and y axes—and with velocity components parallel to the central axis such that the initial motion of the ions will tend to carry them from the entrance end to the exit end of abridged quadrupole 1. Ion velocity components orthogonal to the central axis will, of course, tend to move the ions radially away from the z-axis. If not for the action of potential $\Phi(t)$, such motion would cause ions to collide with electrode sets 100, 200, 300, and/or 400.

When DC potential U is set to zero, abridged quadrupole 1 acts to radially confine ions to the central axis and thereby to guide ions from the quadrupole entrance end to the exit end. The dimensions of abridged quadrupole 1, the RF potential V, and the frequency f of the applied waveform must be selected appropriately in order to transmit ions of the desired m/z. These can be readily determined using the well-known Mathieu equations as is well established in the prior art. However, when calculating, for example, the classic "q" or "a" values, the potentials $+/-\Phi_o/2$ are applied at $r_o'$ as opposed to $r_o$.

When DC potential U is non-zero, abridged quadrupole 1 acts as a mass filter—guiding ions of a substantially limited m/z range from the entrance end to the exit end of the quadrupole. In accordance with the Mathieu equations and stability diagram, ions of any desired m/z or range of m/z may be transmitted through abridged quadrupole 1. The trajectories of other ions will be unstable and these ions will be ejected radially from abridged quadrupole 1 or will collide with the electrodes. Mass spectra may be obtained by scanning the amplitude of the RF waveform, V, together with the DC potential, U, and recording the intensity of the transmitted ion beam as a function of the waveform amplitude.

Figure 2:
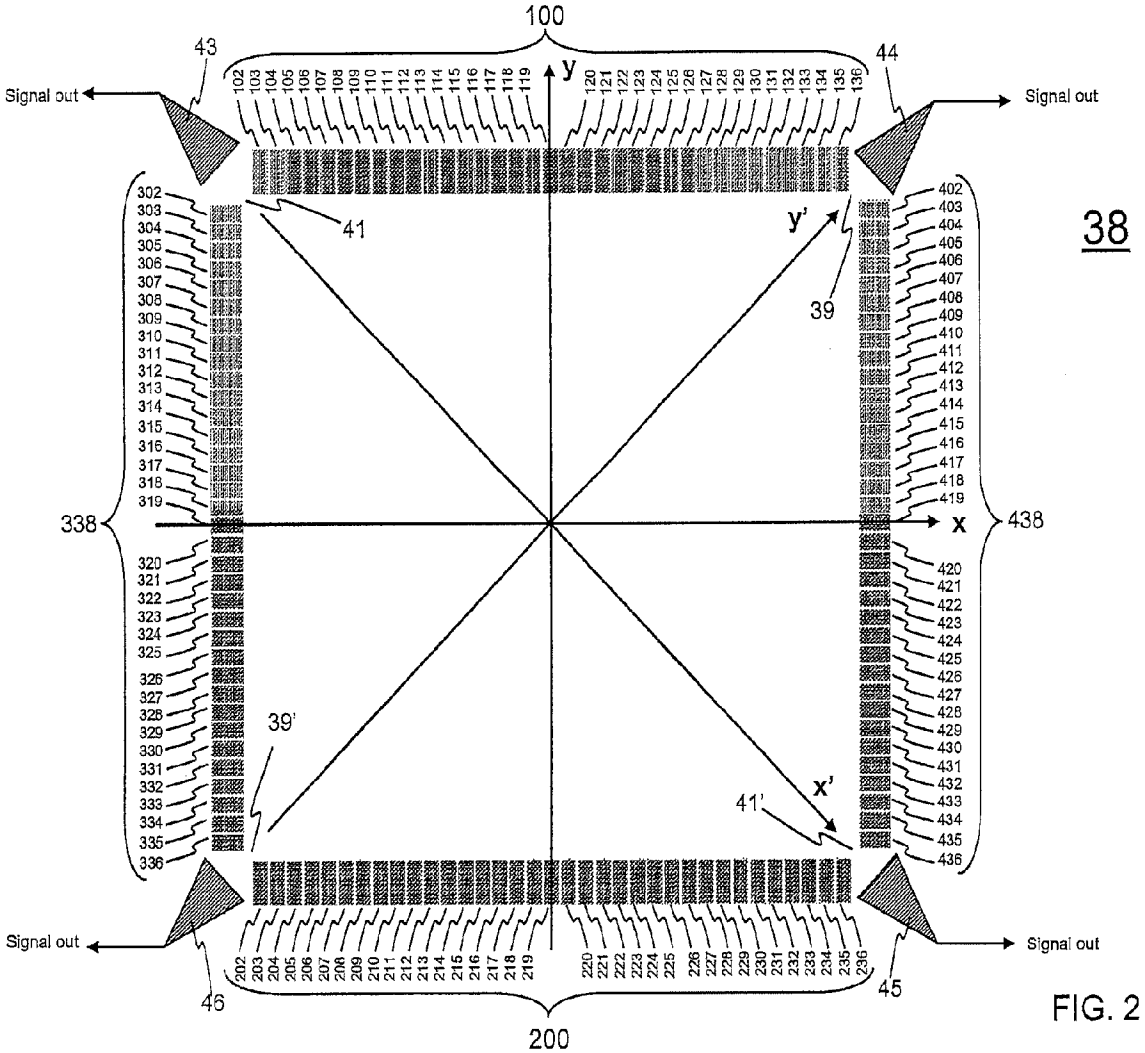
FIG. 2 is a cross-sectional view of an abridged quadrupole according to the present invention including detectors positioned along the x' and y' axes.

In an alternate embodiment, gaps may be left in the array of electrodes in the locations where the lines of electrodes would otherwise intersect. As an example, FIG. 2 depicts a cross sectional view of abridged quadrupole 38 according to the present invention. Abridged quadrupole 38 is identical to quadrupole 1 except for the absence of electrodes 101, 201, 301, 401, 137, 237, 337, and 437 from the corners of the assembly. Electrode sets 138, 238, 338, and 438 of abridged quadrupole 38 are electrically connected and driven in substantially the same manner as described above with respect to abridge quadrupole 1.

Under mass selective stability conditions, ions in a narrow range of m/z values will follow stable trajectories through abridged quadrupole 38. All, or at least some fraction of the ions following unstable trajectories will be ejected through gaps 39, 39', 41, and 41' at the intersections of electrode sets 138, 238, 338, and 438. Unstable ions of low m/z will be ejected through gaps on opposing sides of abridged quadrupole 38. Assuming U is a positive voltage and assuming positively charge ions, the low m/z ions will be ejected through gaps 41 and 41' along the x' axis. Unstable ions of higher m/z than the stable m/z range would be ejected through gaps 39 and 39' along the y' axis.

Unstable ions that are ejected through gaps 39, 39', 41, and 41' may be detected via an ion detector or transmitted to another ion optical device for further analysis. As an example, in FIG. 2 detectors 43 and 45, and 44 and 46 are placed along the x' and y' axes respectively so as to detect ions of lower and higher m/z respectively than the stable m/z range. Detectors 43-46 may be channeltrons, microchannel plates detectors, dynode multipliers, Faraday cups, or any other prior art detectors. Detectors 43-46 may be extended along the z-axis. Ions within the selected m/z range following stable trajectories will be transmitted from the entrance end to the exit end of abridged quadrupole 38. These transmitted ions may be detected at the exit end of quadrupole 38 using an ion detector as is known in the prior art. Mass spectra may be obtained by scanning the amplitude of the RF waveform, V, together with the DC potential, U, and recording the intensity of the transmitted ion beam as a function of the waveform amplitude. Alternatively, selected ions may pass into downstream ion optic devices or mass analyzers.

Outside of the selected m/z range, the trajectory of the ions will be unstable and ions will be ejected through gaps 39, 39', 41, and 41' along the x' and y' axes and may be detected in detectors 43-46. Observing the signals from detectors 43-46 can provide information on what fraction of the ion beam entering abridged quadrupole 38 has an m/z lower than the selected m/z range and what fraction is higher. If the responsiveness of detectors 43-46 and the detector at the exit of quadrupole 38 are identical, and if the ion beam entering quadrupole 38 is constant, then the sum of the signals from all the detectors should be constant throughout a mass scan. In alternate embodiments, the detectors might be calibrated against one another—i.e. 60% of the signal from one detector may be taken to be equal to the full signal from another. Such differences between the observed signals between one detector and another may be due either to differences in the detectors themselves—i.e. conversion efficiency or gain—or may be due to differences between the transmission efficiency of ions through the various gaps 39, 39', 41, and 41' and out of the exit end of abridged quadrupole 38.

Nonetheless, the sum of the responses of detectors 43-46 and the exit detector may be useful as a means of monitoring fluctuations in the ion beam current entering quadrupole 38. This information may, for example, be used to normalize the signal intensities recorded in mass spectra obtained via mass selective stability scans. As an example, if the intensity of the ion beam entering abridged quadrupole 38 drops by a factor of two in the middle of a mass stability scan, then the mass spectral peaks observed in the second half of the resultant spectrum will have areas which are half of what they should be relative to peaks in the first half of the spectrum. However, by monitoring the ion beam current entering abridged quadrupole 38, it is possible to correct the relative intensities of the observed peaks. For example, the entering ion beam current—measured as the sum of the signals from all detectors 43-46 plus the detector at the exit of quadrupole 38—can be recorded as a function of time during the scan. Afterwards, the recorded mass spectrum can be divided by the simultaneously recorded "entering ion beam current", thus normalizing the exit detector response—i.e. peak intensity—to the entering ion beam current. Alternatively, the exit detector signal may be divided in hardware—e.g. via op amps—by the sum of the signals from detectors 43-46 plus the exit detector. This would produce a signal that is already normalized against the entering ion beam current and which can be recorded to produce a normalized mass spectrum.

In addition, mass spectra may be obtained by scanning the amplitude of the RF waveform, V, together with the DC potential, U, and recording the intensities of the ejected ion beams as a function of the waveform amplitude. If the amplitudes of V and U are scanned from low to high potentials, then at the beginning of the scan all ions will be ejected along the y' axis into detectors 44 and 46. The signal on the exit detector and on detectors 43 and 45 will start near zero. As potentials V and U are scanned to higher values, ions of increasing m/z will first be transmitted to the exit detector and later will be ejected along the x' axis onto detectors 43 and 45. The signal at the exit of abridged quadrupole 38 will rise and fall as ions of a given m/z are first transmitted and then fall onto the low m/z side of the transmitted mass range. The signal from detectors 44 and 46 will tend to fall during the course of the scan—decreasing abruptly as high abundance ions assume stable trajectories and then are ejected into detectors 43 and 45. Taking a negative derivative of the signal from detectors 44 and 46 will produce a mass spectrum which is substantially similar to that obtained from the exit detector. The signal from detectors 43 and 45 will tend to rise during the course of the scan—increasing abruptly as high abundance ions assume unstable trajectories as the selected m/z range moves to higher m/z. The ions, then being of lower m/z than the selected range, are ejected into detector 43 and 45. Taking the derivative of the signal recorded at detectors 43 and 45 as a function of time will produce a mass spectrum which is substantially similar to that obtained from the exit detector and via detectors 44 and 46. These three spectra may be compared or summed with each other to produce more reliable, better signal-to-noise results.

Turning next to FIG. 3, abridged quadrupole 1 is depicted with equipotential lines representing a homogeneous dipole field. Mathematically, the dipole field can be represented as a potential that varies linearly along both the x and y axes. Adding a dipole field to the quadrupolar field of equation (8) results in:

$$\Phi(t) = \frac{-\Phi_o(t)\cdot x\cdot y}{2r_o^2} + E_x(t)\cdot x + E_y(t)\cdot y + c \tag{12}$$

where $E_x(t)$ is the dipole electric field strength along the x-axis, $E_y(t)$ is the dipole electric field strength along the y-axis, and where c, the reference potential by which abridged quadrupole 1 is offset from ground, is added simply for completeness. In calculating equipotential lines 47-55 of FIG. 3A, $\Phi_o(t)$ and $E_y(t)$ were taken to be zero and $E_x(t)$ was taken to be 100 V/mm. Equipotential lines are drawn in FIG. 3A at 40V intervals. Lines 51, 52, 53, 54, and 55 represent the 0V, 40V, 80V, 120V, and 160V equipotentials respectively. Similarly, lines 50, 49, 48, and 47 represent the −40V, −80V, −120V, and −160V equipotentials respectively.

Figure 3A:
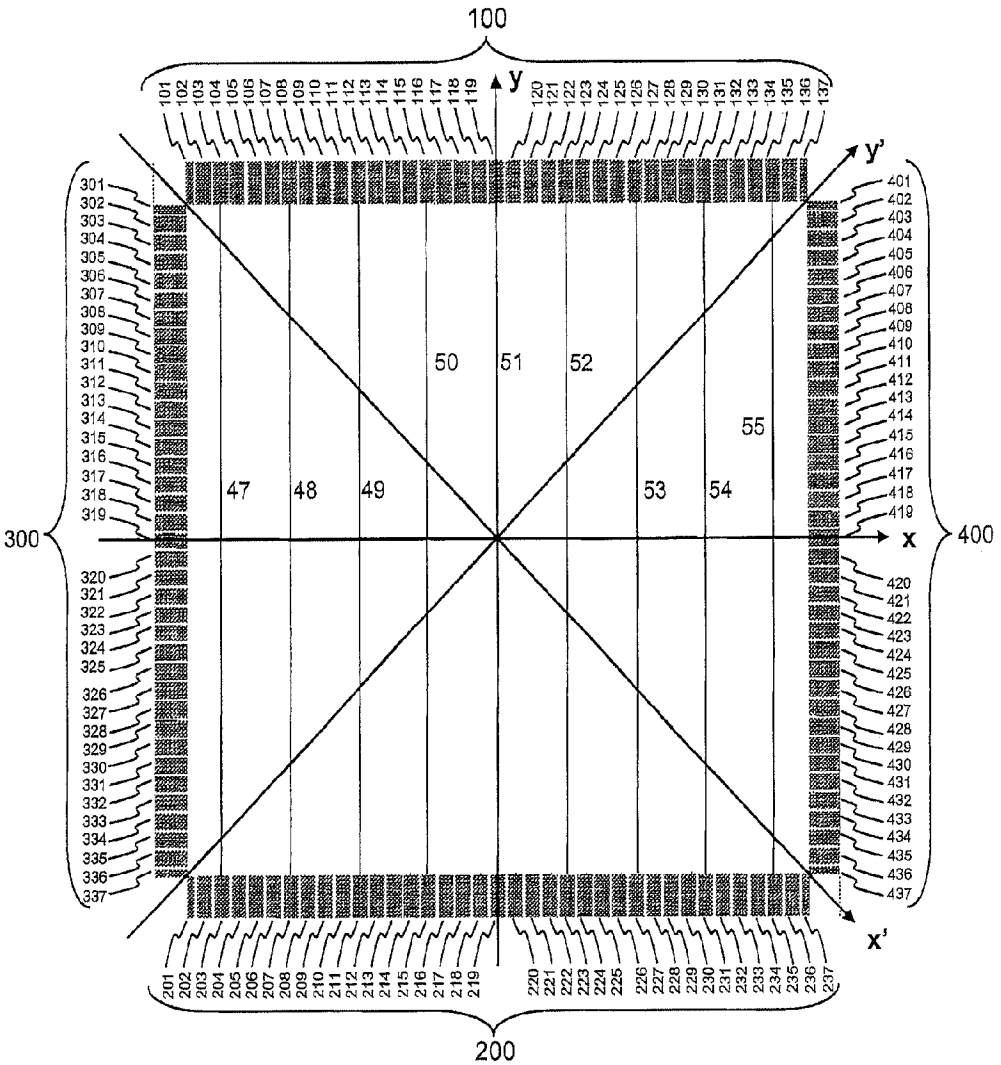
FIG. 3A is a cross-sectional view of an abridged quadrupole according to the present invention with equipotential lines calculated to be formed when the abridged quadrupole is operated so as to form a homogeneous dipole field along the x-axis.

To produce the dipole field represented in FIG. 3A, potentials were applied to the electrodes of abridged quadrupole 1 as described above and with reference to equation (12). Thus, a potential of 10V, 20V, 30V, etc. is applied to electrodes 120, 121, 122, etc. respectively. Further, a potential of 10V, 20V, 30V, etc. is applied to electrodes 220, 221, 222, etc. respectively. Also, in accordance with equation (12) electrodes 137, 237, and 401-437 are all held at a potential of 180V. Similarly, electrodes 101, 201, and 301-337 are all held at a potential of −180V.

As described above with respect to FIG. 1, potentials may be applied to electrode sets 100, 200, 300, and 400 via any known prior art method. However, as an example, potentials from a driver may be applied directly to electrodes at the corners of abridged quadrupole 1—i.e. where the electrode sets intersect. That is, the potential 180V may be applied directly to electrodes 137, 401, 437, and 237 and the potential −180V would be applied to electrodes 101, 201, 301, and 337. From these electrodes—i.e. electrodes 101, 201, 301, 401, 137, 237, 337, and 437—the potentials are divided by known prior art methods and applied to remaining electrodes, 102-136, 202-236, 302-336, and 402-436. The voltage divider may be comprised of a resistor divider and/or a capacitor divider and/or an inductive divider.

Such voltage dividers used to produce a homogeneous dipole field may be identical to those described above with reference to FIG. 1 used to produce an abridged quadrupolar field. That is, in both the case of the quadrupole field generation and the dipole field generation, potentials are linearly divided amongst the electrodes in electrode sets 100, 200, 300, and 400. This feature is represented in equations (8) and (12) wherein the quadrupole potentials $$\frac{-\Phi_o(t)\cdot x\cdot y}{2r_0^2},$$

are a linear function of x and y and the dipole potentials, $E_x(t)x+E_y(t)y$, are also a linear function of x and y. Thus, using a single divider network, a field having both a quadrupolar component and a homogeneous dipolar component can be generated.

Figure 3B:
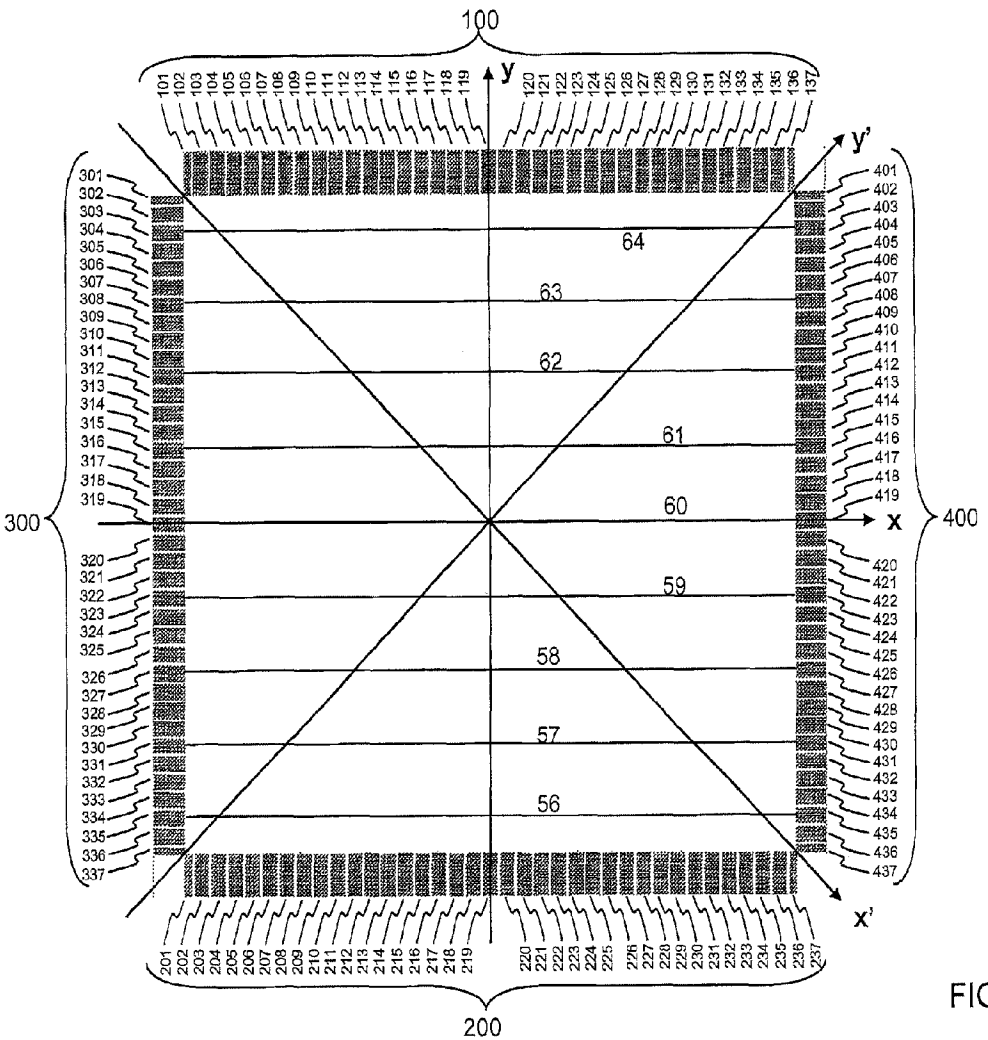
FIG. 3B is a cross-sectional view of an abridged quadrupole according to the present invention with equipotential lines calculated to be formed when the abridged quadrupole is operated so as to form a homogeneous dipole field along the y-axis.

In calculating equipotential lines 56-64 of FIG. 3B, $\Phi_o(t)$ and $E_X(t)$ were taken to be zero and $E_y(t)$ was taken to be 100 V/mm. Equipotential lines are drawn in FIG. 3B at 40V intervals. Lines 60, 61, 62, 63, and 64 represent the 0V, 40V, 80V, 120V, and 160V equipotentials respectively. Similarly, lines 59, 58, 57, and 56 represent the −40V, −80V, −120V, and −160V equipotentials respectively. To produce the dipole field represented in FIG. 3B, potentials were applied to the electrodes of abridged quadrupole 1 as described above and with reference to equation (12). Thus, a potential of 10V, 20V, 30V, etc. is applied to electrodes 319, 318, 317, etc. respectively. Further, a potential of 10V, 20V, 30V, etc. is applied to electrodes 419, 418, 417, etc. respectively. Also, in accordance with equation (12) electrodes 301, 401, and 101-137 are all held at a potential of 180V. Similarly, electrodes 337, 437, and 201-237 are all held at a potential of −180V. Notice that the field in FIG. 3B is homogeneous and of the same strength as that in FIG. 3A. The field is simply, in effect, rotated from the x to the y-axis.

Figure 3C:
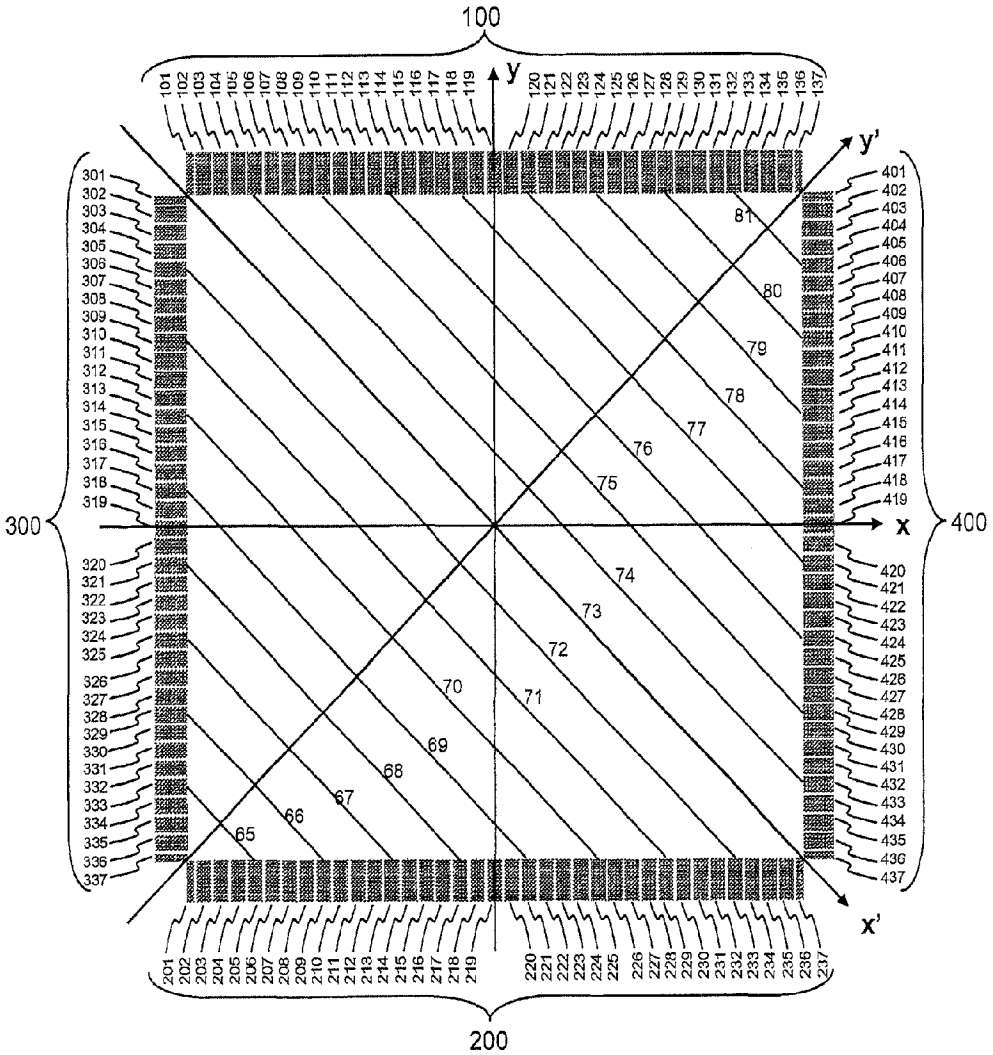
FIG. 3C is a cross-sectional view of an abridged quadrupole according to the present invention with equipotential lines calculated to be formed when the abridged quadrupole is operated so as to form a homogeneous dipole field along the y'-axis.

Finally, in calculating equipotential lines 65-81 of FIG. 3C, $\Phi_o(t)$ was taken to be zero and $E_x(t)$ and $E_y(t)$ were taken to be 100 V/mm. Equipotential lines are drawn in FIG. 3C at 40V intervals. For example, lines 74, 75, 76, and 77 represent the 40V, 80V, 120V, and 160V equipotentials respectively. Similarly, lines 72, 71, 70, and 69 represent the −40V, −80V, −120V, and −160V equipotentials respectively. To produce the dipole field represented in FIG. 3C, potentials were applied to the electrodes of abridged quadrupole 1 as described above and with reference to equation (12). Thus, a potential of 10V, 20V, 30V, etc. is applied to electrodes 436, 435, 434, etc. respectively. Further, a potential of 10V, 20V, 30V, etc. is applied to electrodes 102, 103, 104, etc. respectively. Also, in accordance with equation (12) electrodes 101, 301, 237, and 437 are all held at a potential of 0V. Electrodes 137 and 401 are held at a potential of 360V whereas a potential of −360V is applied to electrodes 201 and 337. As described above, the potential on all other electrodes in electrode sets 100, 200, 300, and 400 can be determined by dividing the above given potentials linearly as a function of electrode position or via equation (12). Again, notice that the field of FIG. 3C is homogeneous and is the sum of the fields of FIGS. 3A and 3B.

It should be noted that $E_x(t)$ and $E_y(t)$ may each be any function of time from DC to complex waveforms, however, as an example, $E_x(t)$ and $E_y(t)$ may be given by:

$$E_x(t)=A_x\cos(2\pi f_x t), \tag{13}$$

$$E_y(t)=A_y\sin(2\pi f_y t), \tag{14}$$

Where $A_x$ and $f_x$ are the amplitude and frequency of the electric dipole waveform along the x-axis and $A_y$ and $f_y$ are the amplitude and frequency of the electric dipole waveform along the x-axis. The amplitudes and frequencies of these waveforms may be any desired amplitude and frequency, however, as an example, one may choose $A_y=A_x$ and $f_y=f_x$. In such a case, one achieves a homogeneous electric dipole of fixed amplitude, $A_x$, that rotates with frequency, $f_x$, about the z-axis.

Such a dipole field may be used, for example, to excite ions into motion about the axis of abridged quadrupole 1. Assuming, for example, a quadrupolar potential according to equations (11) and (12), wherein, V is 200V, and f is 1 MHz, is produced in abridged quadrupole 1, then ions entering quadrupole 1 will tend to be focused to the axis of abridged quadrupole 1. If U is 0V, then ions in abridged quadrupole 1 will oscillate about the axis at a resonant frequency (also known as the ion secular frequency) related to the ion mass. If a rotating dipole field as described above is applied to the abridged quadrupole, at a frequency, $f_x$, which is equal to the secular frequency of ions of a selected mass, then ions of that mass will be excited into a circular motion about the abridged quadrupole axis. If the amplitude, $A_x$, is high enough and the time that the ions are exposed to the dipole field is long enough, then the radius of the ions' circular motion will be large enough to collide with the electrodes comprising the abridged quadrupole and the ions will be destroyed.

In alternate embodiments, dipoles of the form given in equations (13) and (14) may be used to excite ions at their secular frequencies along the x or y-axis or in any direction perpendicular to the axis of abridged quadrupole 1. In further alternate embodiments, the dipole frequency applied along the x-axis may differ from the dipole frequency applied along the y-axis, such that ions of a first secular frequency are excited along the x-axis whereas ions having a second secular frequency are excited along the y-axis. In alternate embodiments, $E_x(t)$ and $E_y(t)$ are complex waveforms that may be represented as being comprised of many sine waves of a multitude of frequencies. Such complex waveforms may therefore be used to simultaneously excite ions of a multitude of secular frequencies. As in the case of the prior art method known as SWIFT, complex waveforms may be built and applied so as to excite all ions except those in selected secular frequency ranges. Such SWIFT waveforms applied via the dipole electric field may be used to eliminate ions of all but selected ranges of masses from abridged quadrupole 1.

Figure 4A:
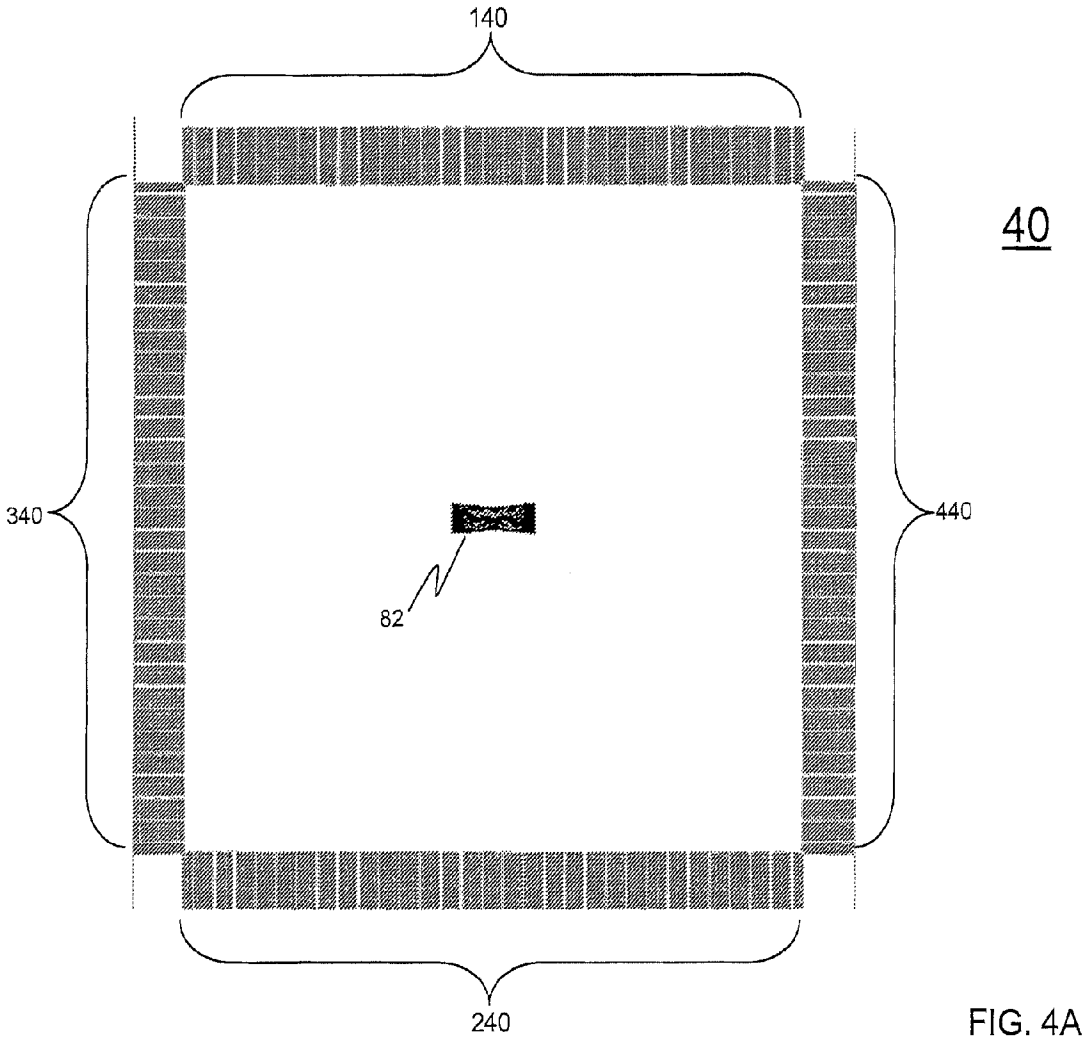
FIG. 4A is a cross-sectional view of an abridged quadrupole according to the present invention and the trajectory of a 400 Da/q ion simulated assuming the abridged quadrupole is operated under multiple frequency RF conditions.
Figure 4B:
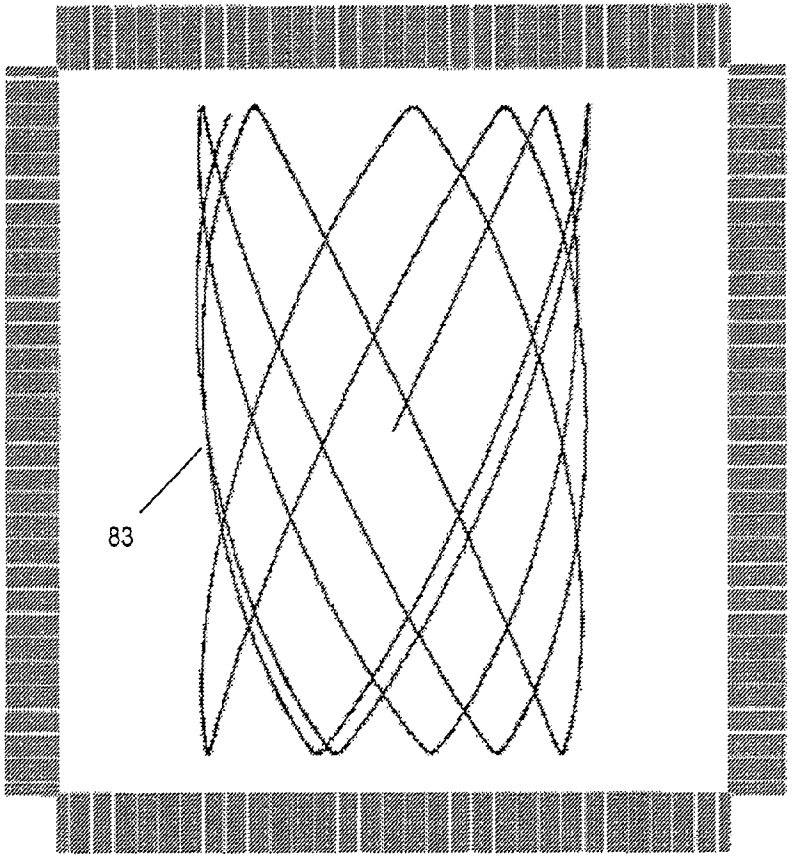
FIG. 4B is a cross-sectional view of an abridged quadrupole according to the present invention and the trajectory of a 40 kDa/q ion simulated assuming the abridged quadrupole is operated under multiple frequency RF conditions.

Turning next to FIGS. 4A and 4B, a cross sectional view of abridged quadrupole 40 is shown. Abridged quadrupole 40 is substantially the same as abridged quadrupole 1 except electrode sets 140, 240, 340, and 440 are comprised of 31 electrodes each whereas electrode sets 100, 200, 300, and 400 are comprised of 37 electrodes each and the inscribed diameter of abridged quadrupole 40 is 3 mm whereas that of abridged quadrupole 1 is 3.6 mm Abridged quadrupole 40 is composed of electrode sets 140, 240, 340, and 440 arranged rectilinearly and symmetrically about a central axis and electrically connected so as to form a multiple frequency multipole field when a proper potential is applied between the electrodes. The electrodes are extended parallel to the central axis, however, when the multipole is viewed in cross section, the electrodes are arranged along four lines, symmetrically about the central axis and form a rectangle. The potentials applied to the electrodes take the form:

$$\text{at } x = +/-r_o;\ \Phi(y, t) = \sum_{i=1}^{j} g_i(y)h_i(t); \tag{15}$$

-continued $$\text{and } y = +/-r_o;\ \Phi(x, t) = \sum_{i=1}^{j} k_i(x)l_i(t). \tag{16}$$

where the functions $g_i(y)$ and $k_i(x)$ may be any functions of position in the y and x dimensions respectively and the functions $h_i(t)$ and $I_i(t)$ may be any functions of time. As an example, equation (15) may take the form:

$$\Phi(t) = \frac{-(V\cdot\sin(2\pi f_1 t)+U)\cdot y}{2r_o} + A_y\sin(2\pi f_y t)\cdot y + c + B_y\sin(2\pi f_2 t)\cos\left(\frac{2\pi y}{a_y}\right) \tag{17}$$

where $f_1$ and $f_2$ are the oscillation frequencies of quadrupolar and heterogeneous dipolar fields respectively. $B_y$ and $a_y$ are constants relating to the amplitude and spatial repetition of the heterogeneous dipolar field. Similarly, equation (16) may take the form:

$$\Phi(t) = \frac{-(V\cdot\sin(2\pi f_1 t)+U)\cdot x}{2r_o} + A_x\sin(2\pi f_x t)\cdot x + c - B_x\sin(2\pi f_2 t)\cos\left(\frac{2\pi x}{a_x}\right) \tag{18}$$

where $B_x$ and $a_x$ are constants relating to the amplitude and spatial repetition of the heterogeneous dipolar field.

Simulated ion trajectories 82 and 83 depicted in FIGS. 4A and 4B were calculated assuming the conditions given by equations (17) and (18) where U, $A_x$, $A_y$, and c were taken to be zero. V, $B_x$, and $B_y$ were taken to be 100V. $f_1$ and $f_2$ were taken to be 1 MHz and 0.5 MHz, respectively, and $a_x$ and $a_y$ were taken to be 0.2 mm. Because the center-to-center spacing between the electrodes is 0.1 mm, the heterogeneous dipole term in equations (17) and (18) alternates from $B_x\sin(2\pi f_2 t)$ to $-B_x\sin(2\pi f_2 t)$ between adjacent electrodes.

A simulated trajectory 82 of an ion having a mass to charge ratio of 400 Da/q is shown in FIG. 4A. Notice in FIG. 4A that the ion is confined near the axis of abridged quadrupole 40 mainly by the action of the higher frequency, quadrupolar component of the multiple frequency field—i.e. $\Phi(t)=V\sin(2\pi ft)xy/2r_o^2$. A simulated trajectory 83 of an ion having a mass to charge ratio of 40 kDa/q is shown in FIG. 4B. For both simulated trajectories, it was assumed that the initial kinetic energy of the ion was 0.1 eV. Notice in FIG. 4B that the ion is confined near the boundaries of abridged multipole 40 mainly by the action of the lower frequency, heterogeneous dipole component of the multiple frequency field. Thus, in a manner similar to prior art multiple frequency multipoles, ions of a broad range of mass to charge ratios may be radially confined and transmitted through the abridged multipole. However, unlike prior art multiple frequency multipoles, no "DC electrode" is required to radially contain the ions. Rather, the multiple frequency field in an abridged quadrupole according to the present invention radially confines the ions by action of the RF field alone.

In alternate embodiments, higher order multipole fields may be formed by comprising an abridged multipole of a larger number of electrode sets. For example, an abridged hexapole may be formed using six sets of electrodes instead of just the four sets thus far described. Within each set, the electrodes are arranged in a line as viewed in the x-y plane.

Figure 12:
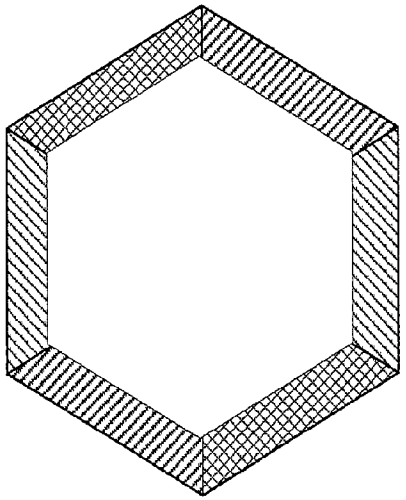
FIG. 12 is an end view of an abridged quadrupole array comprised of six abridged quadrupoles arranged in a hexagon.

The electrode sets are arranged symmetrically around a central axis to form a hexagon in cross sectional view as shown in FIG. 12. As described above with respect to the abridged quadrupole, an RF potential is divided linearly amongst the electrodes of each set so as to form an abridged hexapole field. In a similar manner as described above, a heterogeneous dipole RF field component may be added so as to form a multiple frequency multipole field having hexapole and dipole components.

Electrode sets as described above including electrode sets 100, 200, 300, and 400 and the electrodes of which they are comprised—for example, electrodes 102 and 210—may be formed by any known prior art means. As an example, the electrodes comprising an electrode set may be formed from metal foils. For example, electrode 120 would be formed from a foil 80 μm thick. The edge of the foil would be positioned at $y=r_o$ and the mid-plane of the foil would be positioned at x=0.1 mm. Such metal foil electrodes may be spaced apart from one another in an electrode set using an electrically insulating sheet of, for example, polyimide. This would result in an array of electrodes such as electrode set 100 shown in FIG. 1 wherein the gaps between the electrodes are filled with polyimide. In such a construction, adjacent metal foil electrodes will have an electrical capacitance between them—i.e. adjacent foils will form a capacitor. If the metal foil electrodes comprising an electrode set are all of the same dimensions and are uniformly spaced apart from one another, then they will form a capacitor divider which, as described above, is useful for dividing the applied RF potentials linearly amongst the electrodes. It should be noted that the dielectric constant of the insulating sheet will influence the capacitance between adjacent foil electrodes. Thus, to maintain a uniform capacitance between adjacent electrodes, the dielectric constant of the insulating sheets must also be uniform.

In alternate embodiments, the above mentioned sheets separating the metal foil electrodes may not be insulating, but rather may be electrically resistive. Such a resistive sheet may be formed from any material, however, as an example, the resistive sheets may be formed from graphite doped polypropylene. Within an electrode set, the resistive sheets, electrically connected to one another via the metal foil electrodes, form a resistor divider. If the resistive sheets all have the same dimensions and resistance, then they will form a resistor divider which, as described above, is useful for dividing the applied RF and DC potentials linearly amongst the electrodes of the set. It should be noted that the resistance of the sheets may be any desired value, however, in one embodiment, the resistance of the sheets is chosen so that the resistance of the abridged multipole assembly is sufficiently high that the drive electronics are not overloaded.

In further alternate embodiments, the electrodes of the above mentioned electrode sets may be formed as conducting material bound to insulating supports. For example, the electrodes may be formed as conductive traces on PC boards or ceramic plates. Ideally, that surface of the insulating support which faces the interior of the multipole, and therefore carries the electrodes, should be perfectly flat. In practice, the supporting surface should be flat with the precision needed to perform the desired task. For example, when using an abridged multipole to simply guide ions, the flatness of the supporting surface may be poor—for example 10 to 1000 μm. Alternatively, to use an abridged quadrupole according to the present invention to analyze ions with poor resolution—e.g. 10 Da resolution—a moderate flatness specification should be kept—for example 10-100 μm. However, to analyze ions with an abridged quadrupole and achieve the best possible resolution—i.e. better than 1 Da resolution—a flatness of 10 μm or less should be maintained. In embodiments including insulating supports, such as PC boards or ceramic plates, capacitors and resistors may be added on the back surface of the insulating support—i.e. the surface opposite that which is exposed to the ions. The capacitors and resistors may be used to form the RC divider discussed above for dividing the potentials amongst the electrodes.

Figure 5B:
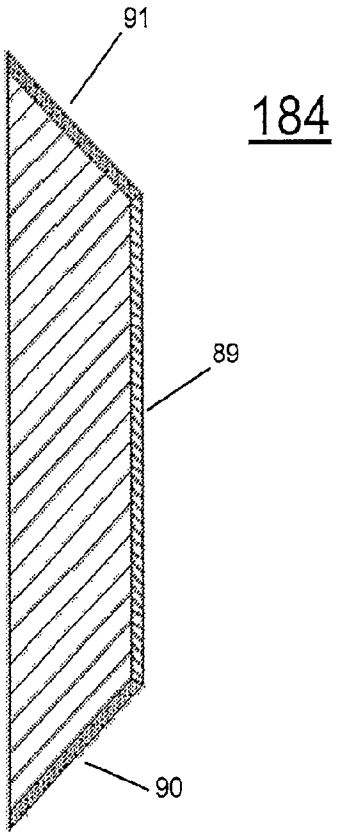
FIG. 5B is a cross sectional view of a plate constructed by depositing a resistive layer and conducting layers on the surfaces of the support depicted in FIG. 5A.
Figure 5A:
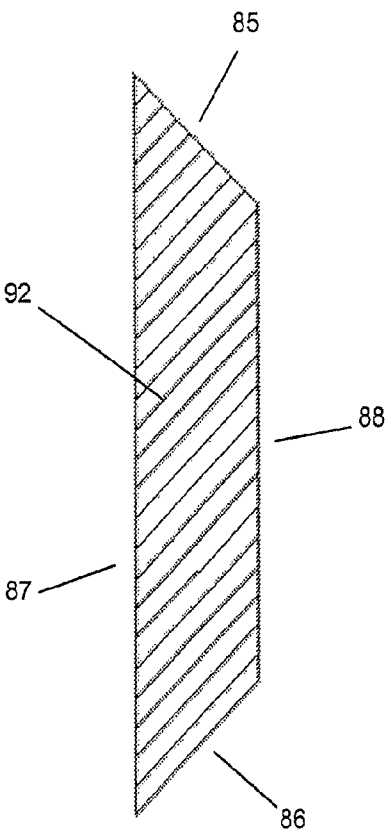
FIG. 5A is a cross-sectional view of an insulating support used in the construction of the abridged quadrupole depicted in FIG. 5C.
Figure 5C:
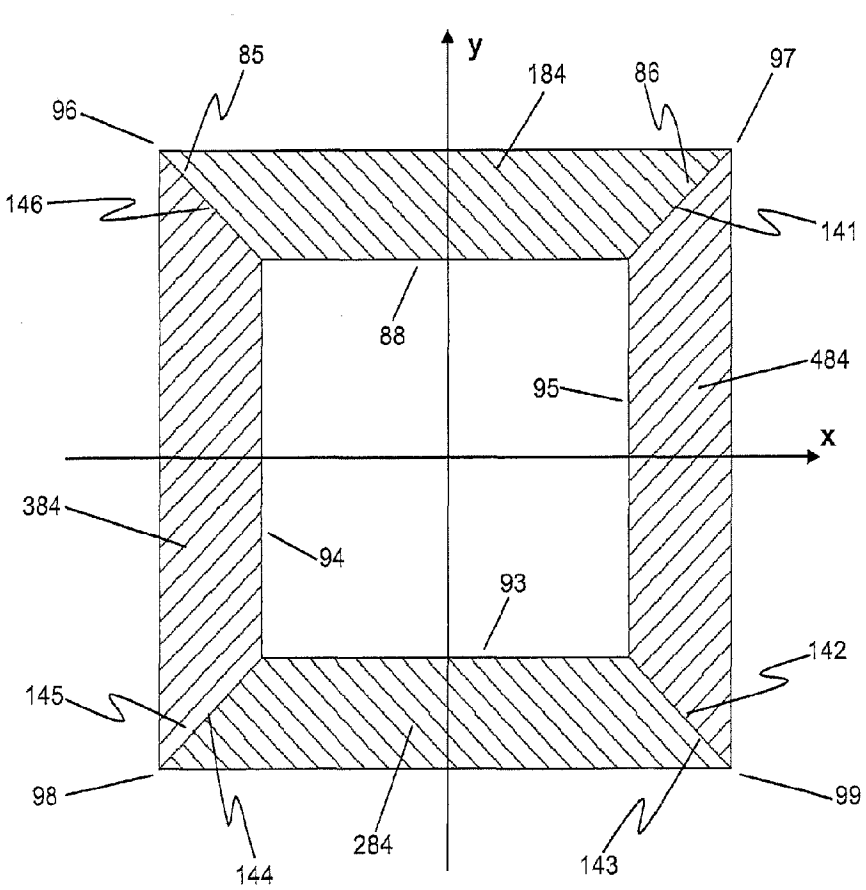
FIG. 5C is a cross sectional view of an abridged quadrupole constructed using four plates substantially identical to that depicted in FIG. 5B.

Turning next to FIGS. 5A, 5B and 5C, yet another alternate embodiment abridged quadrupole is depicted. FIG. 5A shows a cross-sectional view of insulating support 92 used in the construction of abridged quadrupole 84 depicted in FIG. 5C. Insulating support 92 may be comprised of any electrically insulating material, however, as an example, insulating support 92 may be comprised of ceramic. Note that FIGS. 5A and 5B depict cross-sectional views. That is, support 92 extends into the page and has a length which is the same as that of abridged quadrupole 84. Although any insulating material may be used to make support 92, ceramic is especially advantageous in that it is hard and rigid. As shown in FIGS. 5A and 5B, the cross section of support 92 has the form of an isosceles trapezoid with legs 85 and 86 having a 45° angle with respect to base 87 and a 135° angle with respect to base 88. A wide variety of dimensions may be chosen for support 92, however, as an example, base 88 is 3.5 mm long. Support 92 is 1 mm thick and 96.4 mm long (i.e. into the page).

As depicted in FIG. 5B, plate 184 is constructed using support 92 with resistive layer 89 deposited on surface 88 and conducting layers 90 and 91 deposited on surfaces 85 and 86 respectively. The thicknesses of layers 89, 90, and 91 are not shown to scale. The actual thicknesses of layers 89, 90, and 91 may be chosen to be any thickness—even to the extent that, for example, support 92 is replaced by bulk resistive material (for example, graphite doped polymer). However, in the example of FIGS. 5A and 5B, layers 89, 90, and 91 are between $10^{-10}$ and $10^{-5}$ m thick. Resistive layer 89 may be comprised of any known electrically resistive material, however, as an example, resistive layer 89 is comprised of a metal oxide such as tin oxide. Preferably, the resistance of resistive layer 89 is uniform across surface 88, however, in alternate embodiments, the resistance of layer 89 may be non-uniform along the length or width of surface 88. Conductive layers 90 and 91 may be comprised of any electrically conducting material, however as an example, conductive layers 90 and 91 are comprised of a metal, such as gold. Resistive layer 89 is bounded by, and in electrical contact with, conductive layers 90 and 91.

In alternate embodiments, support 92 may be comprised of glass—for example, the type of glass used in the production of microchannel plate detectors (Photonis Inc., Sturbridge, Mass.). Resistive layers may be formed on the surface of such glass by reduction in a hydrogen atmosphere.

In FIG. 5C, abridged quadrupole 84 is constructed using plates 184, 284, 384, and 484. Each of these plates is constructed in the manner described above with respect to plate 184 having supports, and resistive and conductive films. Thus, each plate 184, 284, 384, and 484 has a resistive coating on its inner surface, 88, 93, 94, and 95 respectively. Note that resistive and conductive coatings are not shown in FIG. 5C because these coatings are so thin. In the preferred embodiment, the resistance of the coating on each of the plates 184, 284, 384, and 484 is identical to that on each of the other plates in assembly 84. In alternate embodiments, the resistance of the coating may differ from one plate to another.

As described above with respect to plate 184, each of plates 284, 384, and 484 has a metal coating on those surfaces which appear as legs in the trapezoidal cross section of these plates—i.e. surfaces 141-146. As depicted in FIG. 5C, the metal coated surfaces of adjacent plates are in direct contact with each other when assembled into abridged quadrupole 84. When assembling abridged quadrupole 84, plates 184, 284, 384, and 484 may be held in position by any known prior art means. However, as an example, during the assembly process, the metal coated surfaces of each plate—i.e. surfaces 85, 86, and 141-146—may be coated with a thin layer of solder paste. Plates 184, 284, 384, and 484 may then be held together in a fixture (not shown) such that their metal coated surfaces plus solder paste are in contact as depicted in FIG. 5C. Then plates 184, 284, 384, and 484 together with the fixture may be heated sufficiently to melt the solder paste and thereby solder the metal coatings of adjacent plates together. After cooling, the fixture is removed and the solder will bind the assembly together via the metal coatings on surfaces 85, 86, and 141-146.

Abridged quadrupole 84 has substantially the same geometry as abridged quadrupole 1 and can be used to produce substantially the same field abridged quadrupolar field. Like abridged quadrupole 1, abridged quadrupole 84 is square in cross section, each side being 3.6 mm in length. Like abridged quadrupole 1, abridged quadrupole 84 therefore has an inscribed radius, $r_o$, of 1.8 mm. Electrode sets 100, 200, 300, and 400 of abridged quadrupole1 are represented in abridged quadrupole 84 by the resistive coatings on plates 184, 284, 384, and 484 respectively.

In accordance with equation (8), a quadrupolar field can be formed in abridged quadrupole 84 by applying a potential of $-\Phi_o/2$ at junctions 97 and 98 between adjacent plates 184 and 484 and plates 284 and 384 respectively and a potential of $\Phi_o/2$ at junctions 96 and 99 between adjacent plates 184 and 384 and plates 284 and 484 respectively. Because the resistive coatings on plates 184, 284, 384, and 484 are uniform, the potential difference, $\Phi_o$, applied between the junctions is divided linearly across the resistive coatings in accordance with equations (8), (9), and (10). That is, the potential on the surface of a resistive coating is a linear function of distance between the junctions bounding the resistive coating. For example, the potential on the surface of resistive coating 89 on plate 184 is given by $(-\Phi_o/2r_o)$ x.

The potentials on the resistive coatings of plates 184, 284, 384, and 484 in turn result in an abridged quadrupolar field substantially the same as that depicted in FIG. 1. According to the preferred embodiment, the electric field in the volume encompassed by plates 184, 284, 384, and 484 will take the form given in equation (8).

Figure 6B:
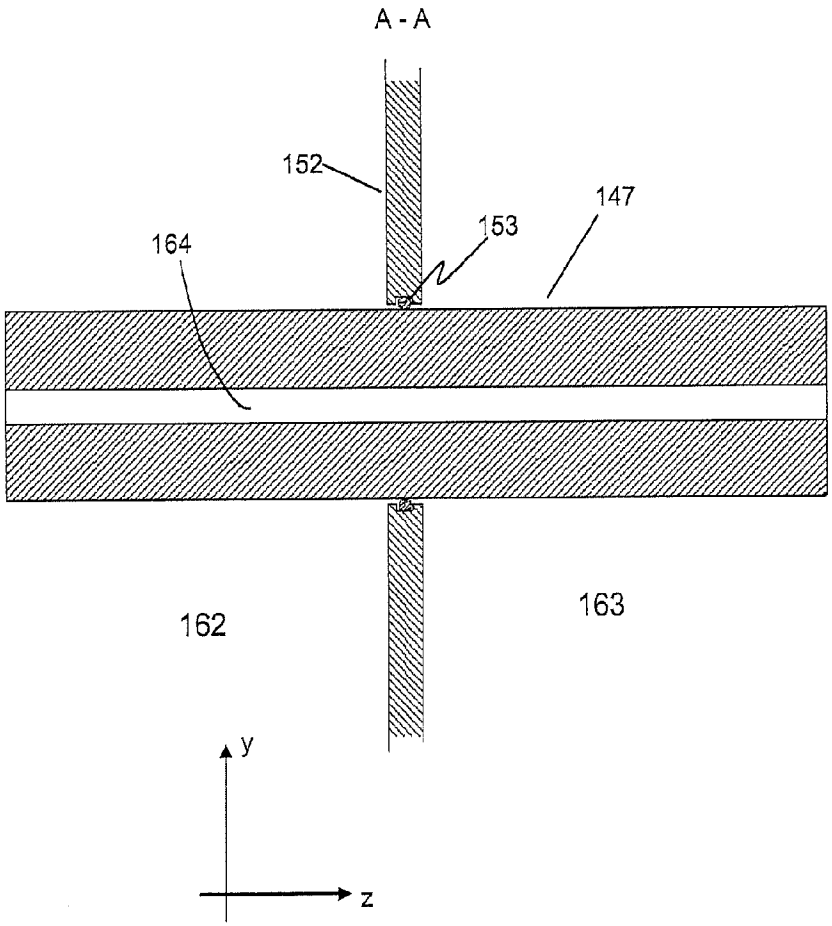
FIG. 6B is a cross-sectional view of an abridged quadrupole according to the present invention comprised of four substantially identical wedge shaped supports arranged symmetrically about a central axis including a pumping restriction and an o-ring.
Figure 6A:
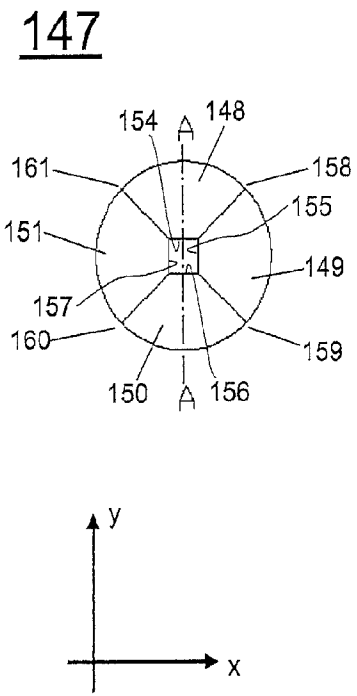
FIG. 6A is an end view of an abridged quadrupole according to the present invention comprised of four substantially identical wedge shaped supports arranged symmetrically about a central axis.

Turning next to FIGS. 6A and 6B, an abridged quadrupole 147 according to the present invention is comprised of four substantially identical wedge shaped supports 148-151 arranged symmetrically about a central axis (i.e. the z-axis). FIG. 6A shows an end view of abridged quadrupole 147 whereas FIG. 6B shows a cross sectional view including pumping restriction 152 and o-ring 153. The construction of abridged quadrupole 147 is substantially identical to that of abridged quadrupole 84 except that supports 148-151 have wedge shaped cross sections whereas supports 184, 284, 384, and 484 of abridged quadrupole 84 have trapezoidal cross sections. Inner surfaces 154, 155, 156, and 157 of supports 148, 149, 150, and 151 respectively are coated with a resistive film of, for example, tin oxide. The surfaces where adjacent supports come in contact—i.e. at junctions 158-161—are coated with a conductor, for example gold. As described above, adjacent supports are bound together by soldering the conductive surfaces of adjacent supports together forming junctions 158-161. Alternatively, the conductive surfaces of adjacent supports may be bound to each other and electrically connected using conductive epoxy.

In one embodiment, the union between adjacent supports, whether via solder or epoxy, is substantially gas tight. Gas and ions may readily move along the axis of abridged quadrupole 147—i.e. the z-axis—however, the flow of gas or ions between the conductive surfaces of adjacent supports—i.e. through junctions 158-161—is negligible. The outer surfaces of supports 148-151 are rounded such that the outer surface of abridged quadrupole 147 is substantially cylindrical. The outer surface of abridged quadrupole 147 and the inner surface of pumping restriction 152 are smooth such that a seal may be formed between abridged quadrupole 147 and pumping restriction 152 via o-ring 153. Pumping restriction 152 is, in effect a wall between two pumping regions 162, and 163 in a vacuum system (not shown). During normal operation, pumping regions 162 and 163 are maintained at two different pressures via a pumping system (not shown). During normal operation, an RF potential applied to junctions 158-161 in accordance with equation (8) tends to focus ions toward the axis of abridged quadrupole 147. Thus, ions entering abridged quadrupole 147 at one end will tend to be guided by its abridged quadrupolar field to the other end. Thus, ions are efficiently transmitted from pumping region 162 to pumping region 163, or vice versa, via abridged quadrupole 147.

However, the flow of gas between pumping regions 162 and 163 is restricted via pumping restriction 152, o-ring 153, and abridged quadrupole 147. To pass between pumping regions 162 and 163, gas must flow through channel 164 of abridged quadrupole 147. Unlike prior art multipoles, abridged multipoles according to the present invention do not require physical gaps between the electrodes forming the multipole fields. As a result, channel 164 has a much smaller effective cross section for a given inscribed diameter than prior art multipole ion guides. Thus, the gas conductance of abridged quadrupole 147 is substantially smaller than that of equivalent prior art quadrupoles. Similarly, abridged multipoles—i.e. hexapoles, octapoles, etc.—according to the present invention will have a much smaller gas conductance than equivalent prior art multipoles.

The gas conductance of abridged quadrupole 147 is inversely proportional to its length, however, its ion conductance is not strongly dependent on its length. Thus, the gas conductance between pumping regions 162 and 163 can be decreased without significantly influencing the transmission of ions from one pumping stage to the next. In an instrument with a differential pumping system between an ion source and an ion analyzer, this implies that a higher pressure difference between pumping stages can be maintained without substantial losses in ion signal.

While the embodiment depicted in FIGS. 6A and 6B has an inscribed radius of 1.8 mm, alternate embodiment abridged quadrupoles may have any desired inscribed radius. The gas conductance of an abridged quadrupole under molecular flow conditions is roughly proportional to the cross sectional area of the channel through the abridged quadrupole. Thus, an abridged quadrupole having an inscribed radius of 0.9 mm would have a gas conductance about four times less than abridged quadrupole 147 assuming the two abridged quadrupoles are the same length. The gas conductance of an abridged quadrupole of any particular dimensions may be estimated using gas flow theory and equations which are well known in the prior art. By selecting an abridged quadrupole of a particular inscribed radius and length, it is possible to construct a system having a desired gas and ion conductance. An abridged multipole similar to multipole 147 may be any length along the central axis. In alternate embodiments, the abridged multipole is arbitrarily short and thus takes the form of a plate with an aperture in it.

In alternate embodiments, the abridged multipole may have a different inscribed diameter at the entrance end than at the exit end. For example, the abridged multipole may have a larger inscribed diameter at the entrance end than at the exit end. This would allow the abridged multipole to collect ions efficiently at the entrance end and focus them down to a tighter beam at the exit end. In this respect, such an abridged multipole could perform the function of an ion funnel.

Figure 7B:
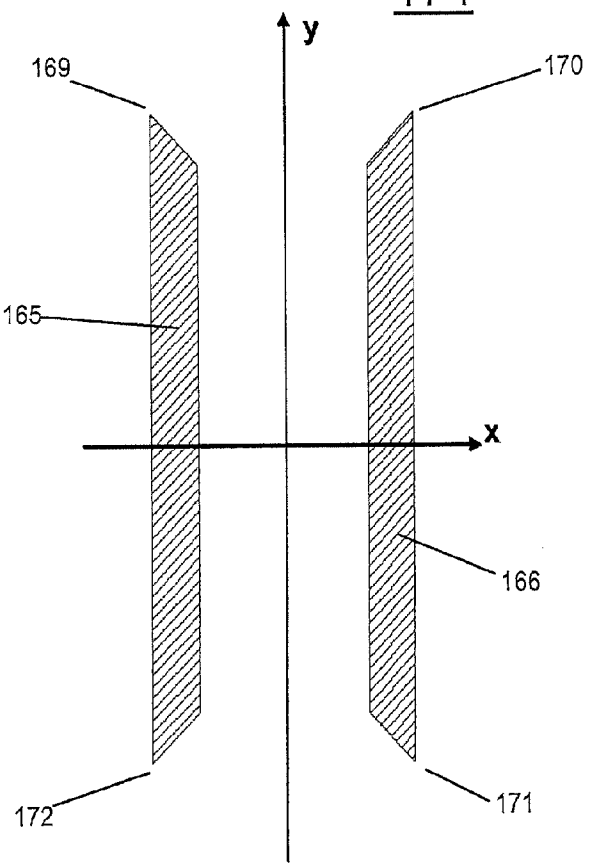
FIG. 7B is a cross sectional view of yet another alternate embodiment abridged quadrupole formed from only two elements.
Figure 7A:
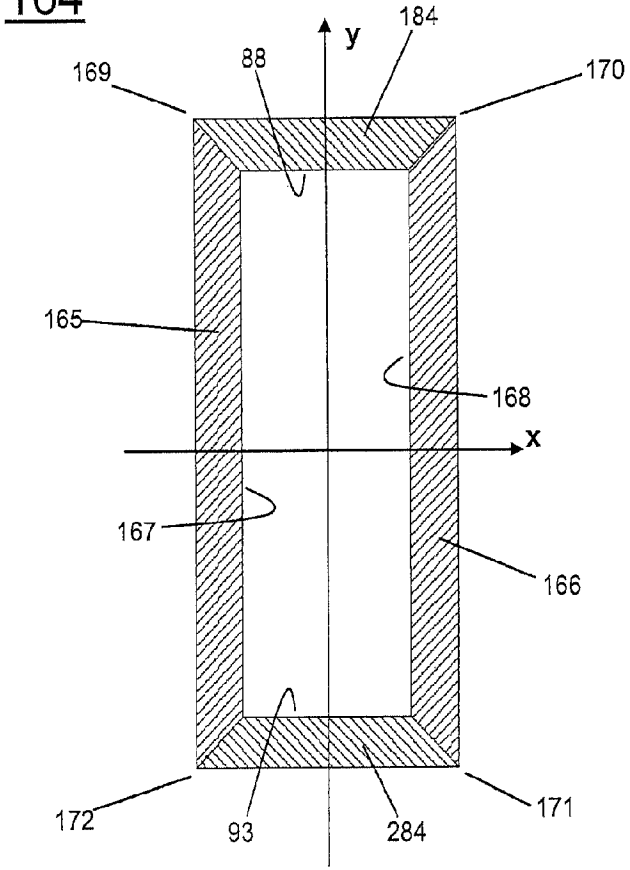
FIG. 7A is a cross-sectional view of an abridged quadrupole according to the present invention wherein the quadrupole is extended further along the y-axis than it is along the x-axis.

Turning next to FIG. 7A, a cross-sectional view of abridged quadrupole 164 according to the present invention is shown wherein the quadrupole is extended further along the y-axis than it is along the x-axis. Abridged quadrupole 164 of FIG. 7A is identical to abridged quadrupole 84 of FIGS. 5A, 5B and 5C except plates 165 and 166 are 10.8 mm long along the y-axis on their inner surfaces 167 and 168 thus producing a rectangular geometry as opposed to the square geometry of quadrupole 84. However, like plates 184 and 284, inner surfaces 167 and 168 are coated with a uniform, electrically resistive coating such that the potentials applied at junctions 169-172 are divided linearly as a function of position along surfaces 167 and 168 in accordance with equation (8).

Here the inscribed diameter, $2r_o$, is taken to be the minimum distance between opposite surfaces along the x axis. By this definition, abridged quadrupoles 84 and 164 have the same inscribed diameter. However, to produce a field of the same strength in abridged quadrupole 164 as in abridged quadrupole 84, the potentials applied to junctions 169-172 will, in accordance with equation (8), need to be three times greater than that applied to the equivalent junctions of quadrupole 84.

In alternate embodiments, the dimensions of an abridged quadrupole along the x and y axes may be any desired dimension. Increasing the dimension of the quadrupole either along the x or y axis will, in accordance with equation (8), require proportionally larger potentials at the junctions of the quadrupole in order to produce the same field within the abridged quadrupole. Making an abridged quadrupole five times larger along the y axis while maintaining its dimension along the x axis will require potentials five times greater at the junctions in order to produce a given field. Alternatively, making an abridged quadrupole five times larger along the y axis while simultaneously decreasing its dimension along the x axis by a factor of five would require the same potentials at the junction to produce a given field.

In alternate embodiments, the length of an abridged quadrupole in one dimension, for example the x-axis, may be arbitrarily small whereas its length in a second dimension, for example along the y-axis, may be arbitrarily large. Notice, in all embodiments, the abridged quadrupole is extended along the z-axis. In the limit, the spatial extent of the quadrupolar field is vanishingly small along the x-axis and has no dependence on position along the z-axis. Thus, in the limit, a spatially one dimensional—in this example, spatially extended with quadrupolar dependence only along the y-axis—quadrupolar field may be formed. Further, in embodiments where the extent of the quadrupolar field is small along the x-axis—e.g. $r_o$<0.5 mm—the abridged quadrupole may act as a "miniature" abridged quadrupole—i.e. taking on many of the attributes of prior art miniature quadrupoles. For example, when $r_o$ is sufficiently small, the abridged quadrupole may be operated at elevated pressures.

FIG. 7B is a cross sectional view of yet another alternate embodiment abridged quadrupole formed from only two elements. Abridged quadrupole 174 depicted in FIG. 7B is identical abridged quadrupole 164 of FIG. 7A except that plates 184 and 284 have been removed. The abridged quadrupole field is thus supported only by plates 165 and 166. The field produced in this way will be similar to that produced via the embodiment of FIG. 7A when applying the same potentials at the junctions 169-172. However, in the embodiment of FIG. 7B the quadrupolar field will be distorted at large values of y. That is, at small values of y, near the axis of the device, the field is well described by equation (8). However, at large values of y, the field will be distorted as compared to equation (8) and the pseudopotential will be weakened relative to a purely quadrupolar field.

Even though the embodiment of FIG. 7B produces a non-ideal field, it does offer the advantage of improved simplicity relative to the embodiment of FIG. 7A in that only two plates are required to produce the field. In further alternate embodiments, the quality of the field—i.e. the degree to which the field resembles an ideal quadrupole field as defined by equation (8)—can be improved either by further elongating plates 165 and 166 along the y-axis or by decreasing the inscribed radius—i.e. bringing the plates 165 and 166 closer together. Given the ratio of the extent of plates 165 and 166 along the y-axis to the inscribed radius, the larger the ratio is, the more ideal will be the field produced via the embodiment.

In further embodiments, a supplemental AC potential may be applied to the abridged quadrupole in order to excite ions of selected m/z's or ranges of m/z's. As discussed above and in prior art literature when placed in a quadrupole field, ions will oscillate about the central axis of the quadrupole with a resonant secular frequency. The resonant frequency of motion is dependent on the m/z of the ion and the amplitude, V, and frequency, f, of the RF waveform applied to the device. As a result, ions of a selected m/z may be excited—that is the amplitude of the ion's oscillation about the central axis may be increased—by applying an additional AC waveform to the device at the resonant frequency of the selected ions. If the amplitude of the ions' oscillations is increased enough, they will be ejected from the quadrupole.

In one method according to the present invention, an excitation potential, $E_y(t)$, is applied to abridged quadrupole 174 via junction 169-172 in a manner consistent with equations (12) and (14). According to the present method, $E_x(t)$ and U are set to 0 V, however, in alternate methods, $E_x(t)$ and U may be set to any desired value. According to the present method the frequency of the excitation potential, $f_y$, is selected to be the same as the secular frequency of the ions of a selected m/z. In further alternate methods, the excitation potential, $E_y(t)$, may be comprised of a multitude of excitation frequencies such that ions of a multitude of m/z values may be excited simultaneously. In such further alternate methods, the excitation potential, $E_y(t)$, may have the form of a SWIFT waveform such that ions of a range of masses or multiple ranges of masses may be excited simultaneously.

The potential, $\Phi(t)$, applied to abridged quadrupole 174 may be complex, as implied by equation (12). However, from equations (12) and (14), it is clear that a homogeneous, oscillating dipole excitation field can be formed along the y-axis by applying the potentials $3r_oA_y \sin(2\pi f_y t)$ at junctions 169 and 170 and the potentials $-3r_oA_y \sin(2\pi f_y t)$ at junctions 171 and 172—keeping in mind of course that these potentials are only components of the complete applied potentials, $\Phi(t)$. Such a dipole field will excite the motion of ions only along the y-axis. If the ions are sufficiently excited, they will be ejected along the y-axis without colliding with plates 165 or 166.

In alternate embodiment abridged quadrupoles, any desired dimensions—i.e. extents along the x, y, and z-axes—may be selected for any of the above embodiments. Especially with respect to embodiments similar to that of FIG. 7B, the dimensions of the device can be chosen such that the quality of the field near the axis of the device is sufficient for analytical purposes. Dimensions appropriate for a higher quality field must be selected in order to obtain higher quality analytical results.

Many prior art analytical quadrupoles are operated at frequencies of near one MHz. That is, the potential applied between the rods to produce the quadrupolar field has an RF frequency, f, of near 1 MHz (see equations (1) and (11)). In principle any frequency, f, might be used, however, higher frequencies tend to produce better analytical results because the number of oscillations in the electric field experienced by the ions as they pass through a quadrupole determines, in part, the resolving power of the quadrupole. In prior art instruments, high frequency, high amplitude waveforms, $\Phi_o(t)$, are typically achieved via resonantly tuned LC circuits. In such systems, energy is repeatedly transferred back and forth between an electric field formed between the rods of the quadrupole—the capacitor in the LC circuit—and a magnetic field formed in the secondary coil of an RF generator. As a result, only a small amount of power is required to maintain the waveform.

In contrast, the embodiments of FIGS. 5A, 5B, 5C, 6A, 6B, 7A and 7B rely on a resistive film deposited on supports—for example as in plates 184, 284, 384, and 484—to set the potentials at the boundaries of the abridged quadrupolar field. Each point on these resistive films has a capacitive coupling to all other points on the resistive films of each plate comprising the abridged quadrupole. Thus, in an equivalent circuit, each point on every resistive film has a capacitive connection to every other point on every resistive film. Thus, to generate a quadrupolar electric field within an abridged quadrupole according to the embodiments of FIGS. 5A, 5B, 5C, 6A, 6B, 7A and 7B each of these small capacitances must be charged appropriately. The charges required to charge these equivalent capacitors and thereby generate the quadrupolar electric field must flow across the resistive films to/from the electrical junctions—for example, junctions 96 and 97. The time constant for charging the surfaces of the resistive films and the frequencies of the waveforms that can be supported via the resistive films is given by the resistance of the film and the overall capacitance of the abridged quadrupole. Of course, the capacitance of the abridged quadrupole is given by its geometry.

The overall capacitance of a typical abridged quadrupole may be, for example, 10 pF. In order to operate such an abridged quadrupole at a frequency of 1 MHz, the RC time constant, $\tau$, of the quadrupole would need to be on the order of $10^{-6}$ s. Therefore, the maximum resistance across the resistive films (taken together in parallel would be on the order of, $R=\tau/C=10^5\Omega$. Such a low resistance will cause a large amount of power to be consumed across the resistive films during operation. For example, if an abridged quadrupole having a resistance of $10^5\Omega$ were to be operated at 1 kVpp then the power consumed across the resistive films would be roughly—$P\sim 0.707\ V^2/R=7$ W.

While this kind of power may be supported by appropriate power supplies and waveform generators, it is desirable to reduce the power consumed by, for example, increasing the resistance of the film. One way of increasing the resistance of the film while maintaining the desired potentials on the surface of the resistive film is to increase the capacitive coupling between the resistive film and the junction electrodes. In such a case it is desirable that the capacitive coupling between the resistive film and the junction electrodes is a function of position on the resistive film such that the potential induced on the resistive film via the junction electrodes is a linear function of position. This is, in effect, equivalent to the capacitor divider discussed with respect to FIG. 1 above.

Figure 8B:
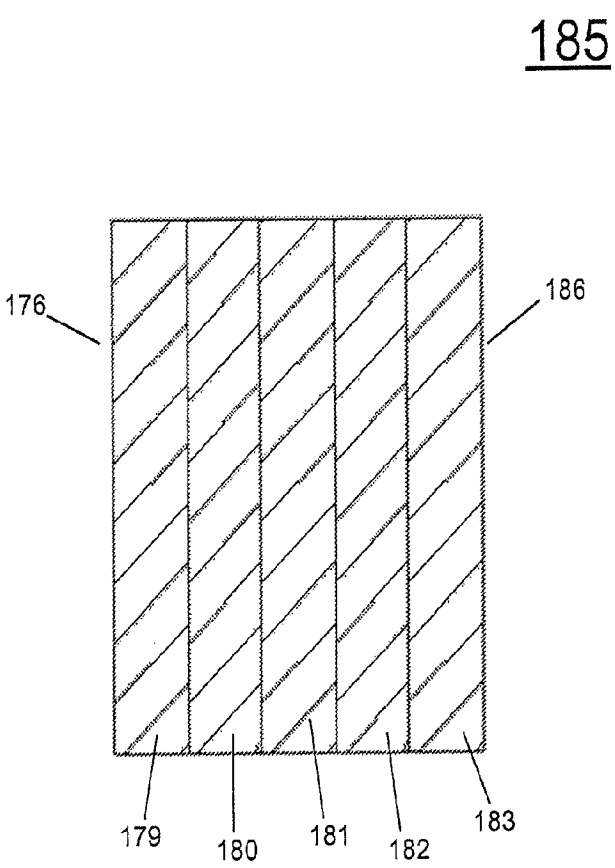
FIG. 8B is a cross-sectional view of set of five elements as described with respect to FIG. 8A stacked together in an assembly.
Figure 8A:
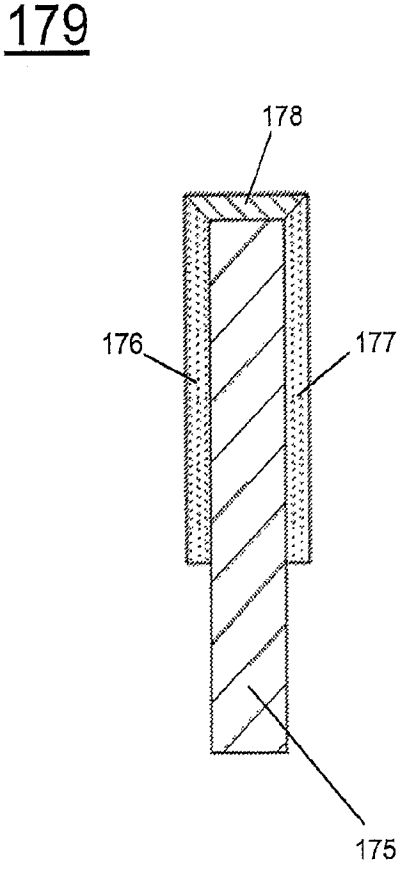
FIG. 8A is a cross sectional view of an element comprised of a rectangular insulating support with thin films of conducting and resistive material on its surfaces.

The embodiments of FIGS. 8A-8C and 9A-9B include such improved capacitive coupling between the resistive film and the junction electrodes. Turning first to FIG. 8A, a cross sectional view is shown of element 179 comprised of a rectangular insulating support 175 with thin films of conducting, 176 and 177, and resistive, 178, material on its surfaces. The thickness of films 176-178 are not shown to scale. The actual thickness of films 176-178 may be chosen to be any thickness—even to the extent that, for example, support 175 is replaced by bulk resistive material (for example, graphite doped polymer). However, in the embodiment of FIG. 8A, films 176-178 are between $10^{-10}$ and $10^{-5}$ m thick. Resistive film 178 may be comprised of any known electrically resistive material, however, as an example, resistive film 178 is comprised of a metal oxide such as tin oxide. Preferably, the resistance of resistive film 178 is uniform across the surface of support 175, however, in alternate embodiments, the resistance of film 178 may be non-uniform along the length or width of support 175. Conductive films 176 and 177 may be comprised of any electrically conducting material, however, as an example, conductive films 176 and 177 are comprised of a metal such as gold. Notice that resistive film 178 is electrically connected to and bounded by conductive films 176 and 177. Notice, also, that insulating support 175 and films 176-178 are extended into the page. The dimensions of the support may be any desired dimensions, however, as an example, support 175 is 0.3 mm thick, 2 mm wide, and 100 mm long (into the page). Conducting films 176 and 177 on opposite sides of support 175 form a capacitor. The capacitance between conductors 176 and 177 in the present embodiment is $C=\epsilon\epsilon_r A/d=8.85*10^{-12}\times 3\times(1.3*10^{-3}\times 0.1)/3*10^{-4}\sim 11$ pF.

In FIG. 8B, a set of five elements as described with respect to FIG. 8A are shown, in cross section, stacked together in an assembly. Each element 179-183 has on it thin conductive and thin resistive films as described with respect to FIG. 8A. Elements 179-183 are aligned with each other such that the metal coated surfaces of adjacent elements are in direct contact with each other when assembled into a set as shown in FIG. 8B. Notice that each of elements 179-183 is oriented such that the resistive film of each element is facing the same way—i.e. toward the top of the page. When assembling set 185, elements 179-183 may be held in position by any known prior art means. However, as an example, during the assembly process, the metal coated surfaces of each plate may be coated with a thin layer of solder paste. Elements 179-183 may then be held together in a fixture such that their metal coated surface plus solder paste are in contact as depicted in FIG. 8B. Then elements 179-183 together with the fixture may be heated sufficiently to melt the solder paste and thereby solder the metal coatings of adjacent elements together. After cooling, the fixture is removed and the solder will bind the assembly together via the metal coatings on elements 179-183. Notice in the complete assembly that the metal films on opposite sides of elements 179-183 form a capacitor divider and the resistive film forms a resistor divider. An electrical potential may be applied across set 185 via the conducting films 176 and 186 at either end of the set.

According to the present embodiment, the capacitances between opposite sides of each of elements 179-186 are all the same. This results in a linear division of potentials applied between conducting films 176 and 186 at opposite ends of set 185. In alternate embodiments the capacitance across the elements forming a set may be any selected capacitance and this capacitance may vary as a function of position within the assembly so as to produce a non-linear division of potentials applied across the set. The capacitance across an element may be varied by, for example, changing the thickness of the support, the dielectric constant of the insulating support, or the area of the conductive coatings on the insulating support.

According to the present embodiment, the resistances across each of elements 179-183 are all the same. This results in a linear division of potentials applied at opposite ends 176 and 186 of set 185. In alternate embodiments, the resistance across the elements forming a set may be any desired resistance and this resistance may vary as a function of position within the assembly so as to produce a non-linear division of potentials applied across the set. The resistance across an element may be varied by changing, for example, the composition or thickness of the resistive film.

Figure 8C:
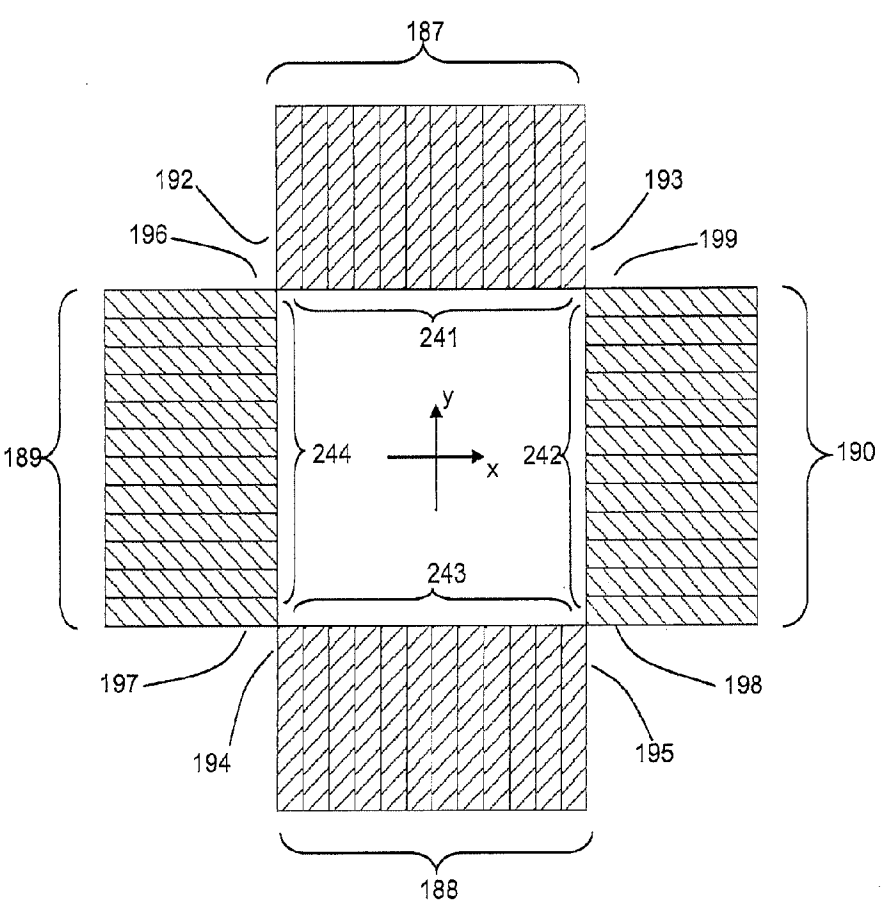
FIG. 8C is a cross-sectional view of an abridged quadrupole formed from sets of elements as described with reference to FIGS. 8A and 8B.

Turning next to FIG. 8C, shown is a cross sectional view of abridged quadrupole 191 formed from sets of elements as described with reference to FIGS. 8A and 8B. Abridged quadrupole 191 is formed from four sets of elements, 187-190, arranged symmetrically about a central axis—i.e. the z-axis. Each set of elements, 187-190, is in turn comprised of 12 elements, each of which is constructed in a similar manner as element 179 as described with reference to FIG. 8A. Notice that the resistive films 241-244 of each set are facing the interior of abridged quadrupole 191. As described with reference to FIG. 8B, an electrical potential may be applied across each of sets 187-190 via the conducting films 192 and 193, 194 and 195, 196 and 197, and 198 and 199 at either end each of the sets 187, 188, 189, and 190 respectively. According to the present embodiment, the capacitances and resistances between opposite sides of each element are the same for every element. This results in a linear division of potentials applied between conducting films 192 and 193, 194 and 195, 196 and 197, and 198 and 199 at either end each of the sets 187, 188, 189, and 190 respectively. By applying the potentials $\Phi_o(t)/2$ at conducting films 192, 195, 196, and 198, and the potential $-\Phi_o(t)/2$ at conducting films 193, 194, 197, and 199, an abridged quadrupolar field can be established in accordance with equation (8).

Figure 9A:
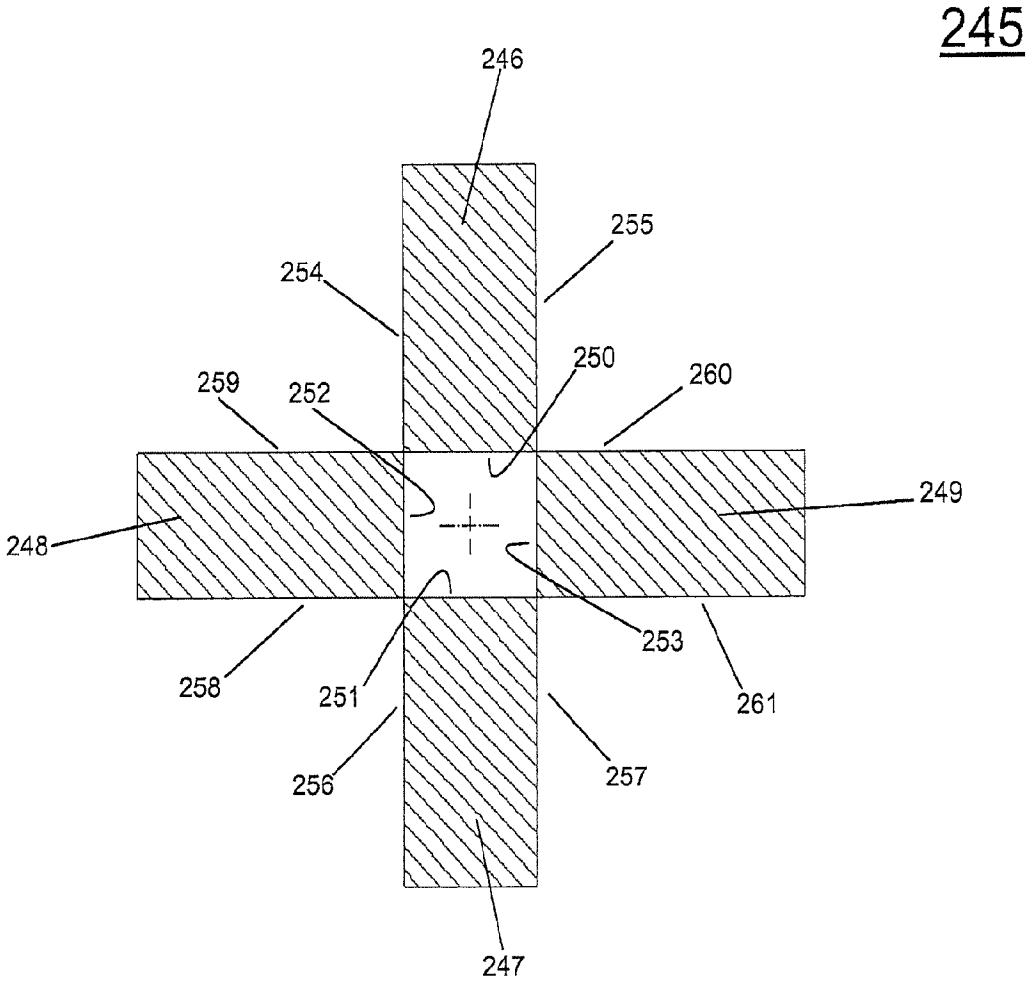
FIG. 9A is a cross-sectional view of yet another alternate embodiment abridged quadrupole consisting of four elements, each of which is of substantially the same construction as that described with reference to FIG. 8A.
Figure 9B:
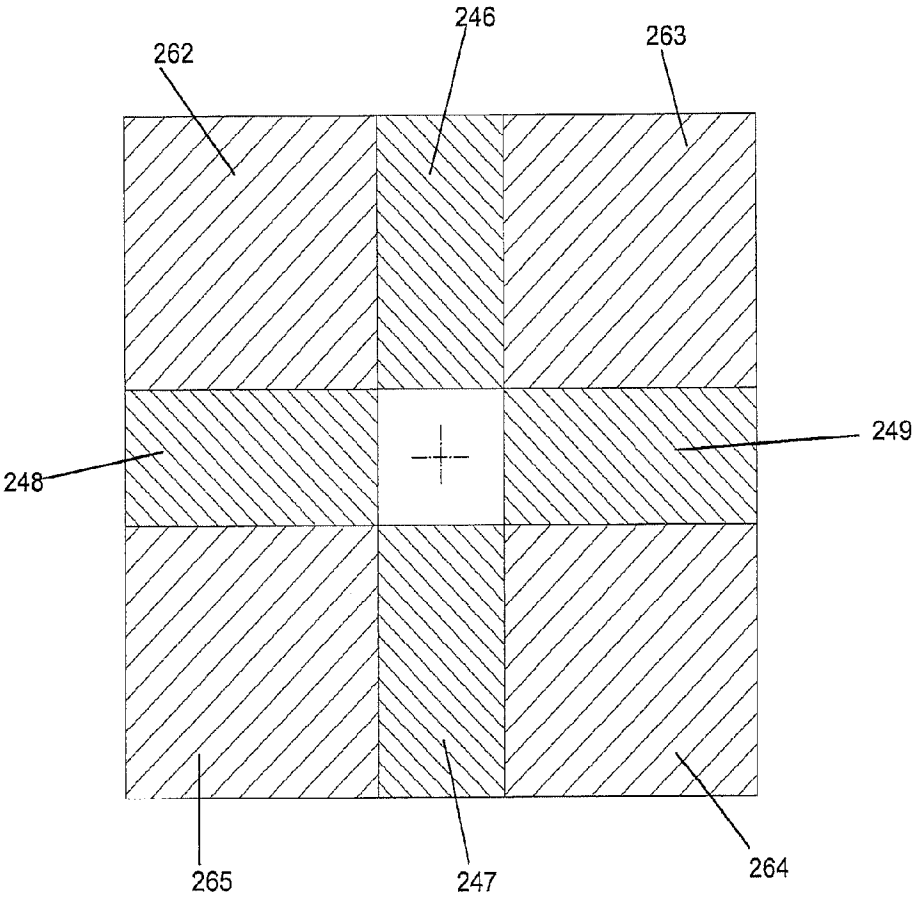
FIG. 9B is a cross-sectional view of the abridged quadrupole of FIG. 9A now also showing braces used for holding the assembly together.

FIGS. 9A and 9B depict a cross sectional view of yet another alternate embodiment abridged quadrupole 245. The embodiment according to FIG. 9A consists of four elements, 246-249. Each of the four elements 246-249 are of substantially the same construction as element 179 described with reference to FIG. 8A. Each element 246-249 is constructed of an insulating support of rectangular cross section. The inner surfaces 250-253 of the supports are covered with a thin film of electrically resistive material. Adjacent surfaces 254-261 are covered with a thin film of electrically conducting material. Within each element 246-249, the conductive and resistive films are in electrical contact with each other. Notice that elements 246-249 and their conducting and resistive films are extended along the z-axis—i.e. into the page. The dimensions of elements 246-249 may be any desired dimensions, however, as an example, elements 246-249 are 5.8 mm thick, 11.6 mm wide, and 200 mm long (into the page). In alternate embodiments, the insulating supports of elements 246-249 may be comprised of any desired insulating material, however, as an example, the supports of elements 246-249 are constructed of a ceramic having a dielectric constant of 20. The high dielectric constant of the ceramic used as the supports in elements 246-249 results in a high capacitive coupling between the resistive film and the conductive films. This increased capacitive coupling between the resistive film and conductive films within each of elements 246-249 causes charge to be induced on the surface of the resistive film when a potential is applied to the conductive films. In effect, the coupling of the resistive film to the conductive films in this way is the same as that of a capacitor divider. The capacitively induced potential on the resistive film is a linear function of position on the film—that is, the distance between the conductive films—in accordance with equation (8).

If one of the elements 246-249 were isolated from the others and from all other electrical influences, then the dielectric constant of the ceramic support would have no influence on the potential induced on the resistive film. Even a relatively weak coupling of the resistive film to the conductive films would result in a linear dependence of induced potential vs. position on the film. However, when in assembly 245 as depicted in FIG. 9A, the capacitively induced potential on the resistive films of any of elements 246-249 will depend also on the potentials on and capacitive coupling of resistive films to each other. The capacitive coupling of the resistive films to the conductive films and the coupling of the resistive films to each other can be calculated by methods well known to the prior art. However, it should be clear from the above discussion that in order to induce as near an ideal potential distribution as possible on the resistive films, one must increase the coupling of the resistive films to the conducting films and/or decrease the coupling of the resistive films—i.e. between elements 246-249—to each other. It is for this reason that using a ceramic having a high dielectric constant as the support in elements 246-249 is valuable. Using ceramic having a dielectric constant of 20 improves the coupling of the resistive film within an element 246-249 to the conductive films within that element by a factor of 20.

FIG. 9B depicts a cross sectional view of abridged quadrupole 245 of FIG. 9A now with rectilinear braces 262-265 holding elements 246-249 in the assembly. According to the present embodiment, each brace 262-265 has a square cross section—11.6×11.6 mm—and extends the length of quadrupole 245—i.e. 20 cm. In alternate embodiments, braces 262-265 need not extend the entire length of abridged quadrupole 245. In alternate embodiments, braces 262-265 need not be square in cross section, but rather may be any desired cross sectional shape including triangular or L shaped in cross section. According to the present embodiment, braces 262-265 are substantially rigid and electrically conducting—for example, gold coated steel.

Each of the metal coated surfaces 254-261 of elements 246-249 are in contact with one of the surfaces of one of the braces 262-265 when assembled into abridged quadrupole 245 as shown in FIG. 9B. When assembling quadrupole 245, elements 246-249, and braces 262-265 may be held in position by any known prior art means. However, as an example, during the assembly process, the metal coated surfaces 254-261 of each element 246-249 may be coated with a thin layer of solder paste. Elements 246-249, and braces 262-265 may then be held together in a fixture (not shown) such that the metal coated surfaces of the elements plus solder paste are in contact with the braces as depicted in FIG. 9B. Then elements 246-249 and braces 262-265 together with the fixture may be heated sufficiently to melt the solder paste and thereby solder metal coatings 254-261 together with braces 262-265. After cooling, the fixture is removed and the solder binds the assembly together. An electrical potential may be readily applied via braces 262-265.

The rectilinear construction of abridged quadrupole 245 has the advantage that it is easy to fabricate with high mechanical precision. The improved coupling between the resistive and conductive films allows for the use of a resistive film having a higher resistance than that used in abridged quadrupole 84. This in turn presents less of a load to the power supply. However, the need to use an insulator having a high dielectric constant also increases the capacitance between conducting films on opposing sides of the supports in elements 246-249. Assuming the supports have a dielectric constant of 20, the capacitance between the conductive films on opposite sides of each of elements 246-249 in the present embodiment is $C=\epsilon\epsilon_r A/d=8.85*10^{-12}\times20\times(1.16*10^{-2}\times0.2)/5.8*10^{-3}\sim70$ pF. Because abridged quadrupole 245 includes four elements 246-249, its total capacitance is 280 pF—significantly higher than conventional prior art quadrupoles of similar dimensions.

Figures 10A, 10B:
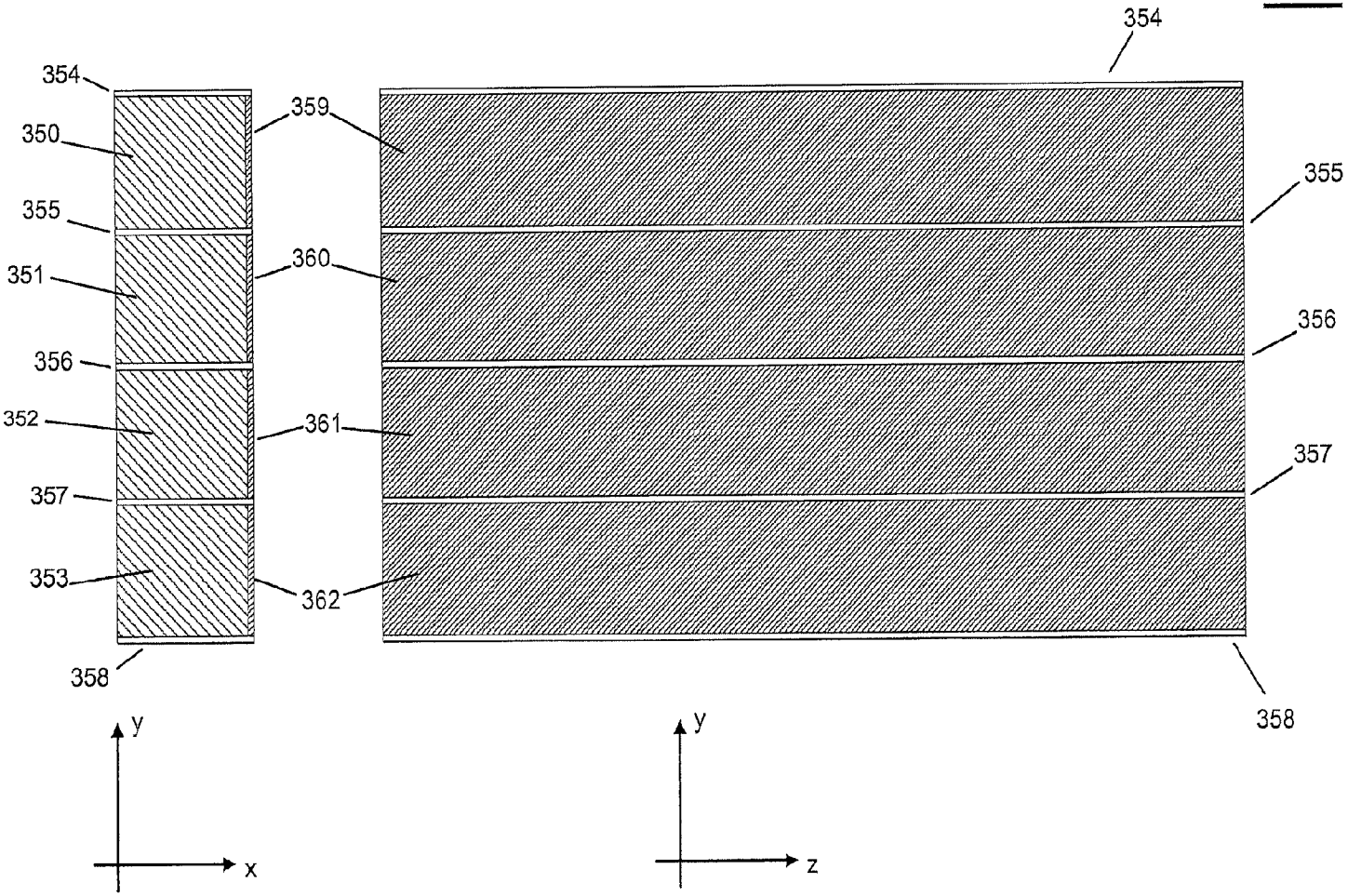
FIG. 10A is an end view of a set of four elements used in the construction of the abridged quadrupole array of FIG. 10C.
FIG. 10B is a side view of a set of four elements used in the construction of the abridged quadrupole array of FIG. 10C.
Figure 10C:
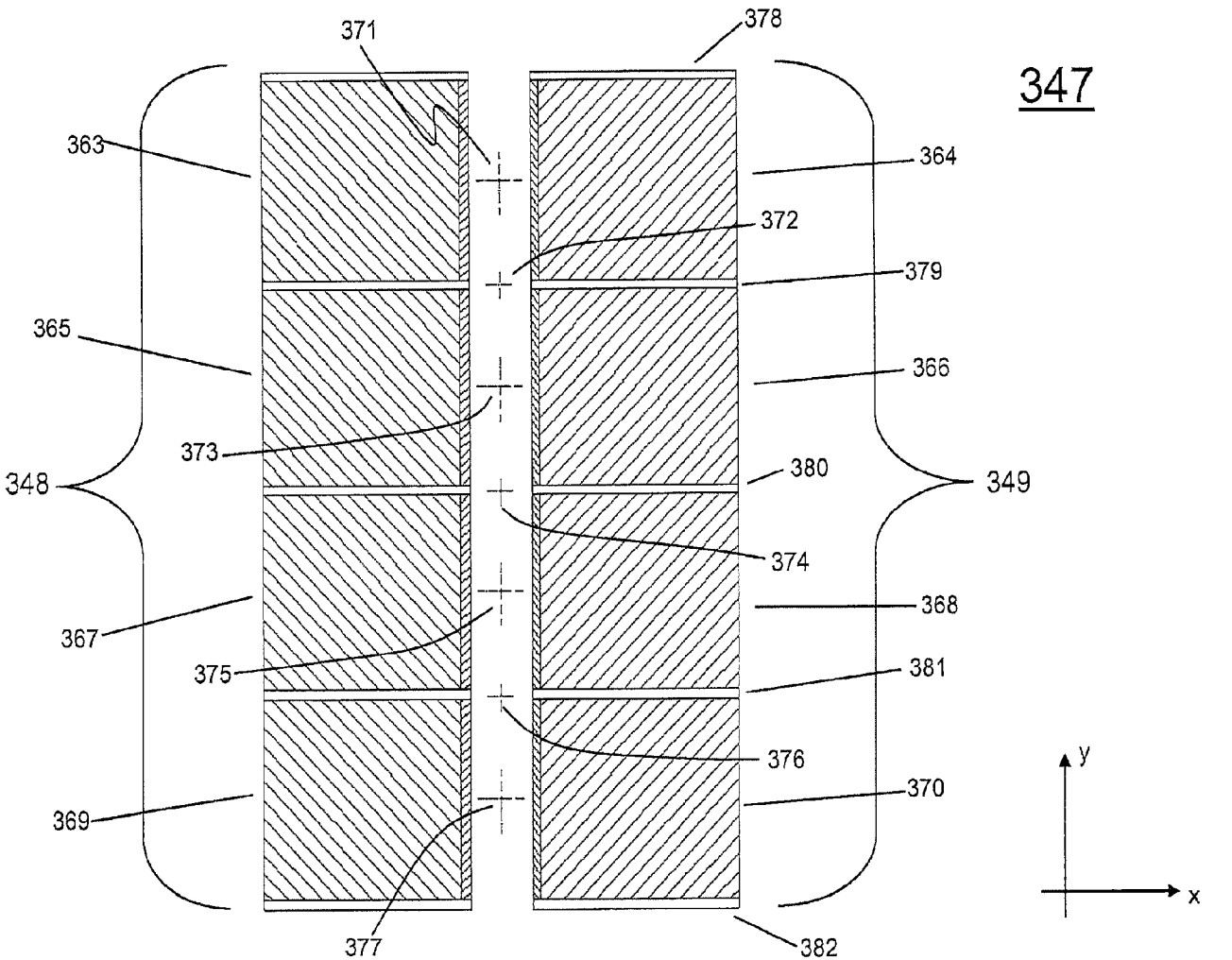
FIG. 10C is an end view of an abridged quadrupole array comprised of four abridged quadrupoles arranged linearly.

Turning next to FIGS. 10A, 10B and 10C, an abridged quadrupole array 347 is shown comprised of four abridged quadrupolar fields arranged linearly. In alternate embodiments, the abridged quadrupole may be comprised of any desired number of quadrupolar fields. Abridged quadrupole array 347 is constructed using two sets of elements 348 and 349 each having similar construction as sets 187-190 described with reference to FIGS. 8A-8C. FIG. 10A depicts an end view of set 348 whereas FIG. 10B depicts a side view of set 348. Set 348 is comprised of square insulating supports 350-353 separated from each other and bounded by electrically conducting plates 354-358. Conducting plates 354-358 may be comprised of any desired conducting material, however, as an example, they are comprised of steel. The inner surfaces of supports 350-353—i.e. those surfaces which face the interior of abridged quadrupole array 347—are covered with electrically resistive material 359-362. The thickness of resistive material 359-362 may be chosen to be any thickness—even to the extent that, for example, supports 350-353 are replaced by bulk resistive material (for example, graphite doped polymer). However, in the present embodiment, resistive material 359-362 is 0.25 mm thick. Resistive material 359-362 may be comprised of any known electrically resistive material, however, as an example, resistive layer 359-362 is comprised of graphite doped polypropylene. Preferably, the resistance of resistive material 359-362 is uniform across the surface of supports 350-353, however, in alternate embodiments, the resistance of resistive material 359-362 may be non-uniform along the length or width of supports 350-353. Notice that each of conductive plates 354-358 is in electrical contact with resistive material 359-362. In alternate embodiments, any of the above described methods of capacitively coupling the resistive film to the metal plates may be used. However, in the present embodiment, the capacitive coupling of resistive films 359-362 to adjacent metal plates 354-358 is increased by making supports 350-353 from ceramic having a high dielectric constant.

In alternate embodiments, the dimensions of the support may be any desired dimensions, however, as an example, each of supports 350-353 is 5 mm square in cross section by 35 mm long. In alternate embodiments, the width of each support is 5 mm, however, the height of the supports varies. For example, in one alternate embodiment, supports 350, 351, 352, and 353 are 5 mm, 7 mm, 9 mm, and 11 mm high respectively—i.e. along the y-axis. Metal plates 354-358 may be of any desired dimensions, however, in the present embodiment, they are 5.25 mm wide, 0.25 mm thick and 35 mm long. Conducting plates 354-358 on opposite sides of each support 350-353 form a capacitor. The capacitance for example, between plates 354 and 355 in the present embodiment is $C=\epsilon\epsilon_r A/d=8.85*10^{-12}\times100\times(5*10^{-3}\times0.033)/5*10^{-3}\sim30$ pF. According to the present embodiment, the capacitances between plates on opposite sides of each of supports 350-353 are all the same. In alternate embodiments, the capacitance across the supports forming a set may be any selected capacitance and this capacitance may vary as a function of position within the assembly. The capacitance across an element may be varied by, for example, changing the thickness of the support, the dielectric constant of the insulating support, or the area of the conductive plates bounding the insulating support.

According to the present embodiment, the resistances through resistive material 359-362 between each of adjacent conducting plates 354-358 are all the same. In alternate embodiments, the resistance between adjacent conducting plates within a set may be any desired resistance and this resistance may vary as a function of position within the assembly so as to produce a non-linear division of potentials applied across the set. The resistance between adjacent conducting plates may be varied by changing, for example, the composition or thickness of the resistive film.

Turning next to FIG. 10C, shown is a cross sectional view of abridged quadrupole array 347 formed from two sets of elements 348 and 349 which are constructed as described with reference to FIGS. 10A and 10B. Abridged quadrupole array 347 is formed by placing two substantially identical sets facing and parallel to each other, and spaced apart from each other along the x-axis. In alternate embodiments, a wide range of geometries and dimensions may be used. For example, in alternate embodiments, sets 348 and 349 may be non-parallel to each other along either the y or z-axes or both. The separation of sets 348 and 349 along the x-axis may vary widely, however, as an example, the spacing between sets 348 and 349 in the present embodiment is 1.66 mm. In as much as sets 348 and 349 have a length of 35 mm as detailed above, abridged quadrupole array 347 also has a length of 35 mm.

Abridged quadrupole array 347 may be viewed as being comprised of four pairs of elements 363 and 364, 356 and 366, 367 and 368, and 369 and 370. Each pair of elements substantially resembles "one dimensional" abridged quadrupole 174 as depicted in FIG. 7B. Each pair of elements can be used to form an abridged quadrupole field around one of central axes 371, 373, 375, or 377. To produce abridged quadrupole fields in array 347, potentials are applied at conducting plates 354-358 and 378-382. As implied above, the inscribed radius of each abridged quadrupole in array 347 is 0.833 mm. Notice that this is ⅓ the distance along the y-axis from one of the central axes—for example axis 371—to an adjacent conducting plate—for example plate 354. As $y=+/-3r_o$ and $x=+/-r_o$ at the conducting plates 354-358 and 378-382, in accordance with equation (8), the potential $3\Phi_o(t)/2$ should be applied at plates 354, 356, 358, 379 and 381 and the potential $-3\Phi_o(t)/2$ should be applied at plates 355, 357, 378, 380, and 382. Such potentials will result in abridged quadrupolar fields about each of axes 371, 373, 375, and 377. The quadrupolar fields thus formed will be of substantially equal spatial extent, quality, and field strength as one another. Each of the abridged quadrupolar fields thus formed will be highly quadrupolar in nature near axes 371, 373, 375, and 377 and less quadrupolar further from the axes.

Each of the abridged quadrupolar fields in array 347 will tend to focus ions towards the axis of that field—i.e. axes 371, 373, 375, and 377. Abridged quadrupole array 347 has two ends along the z-axis through which ions may enter and exit the array. According to the present embodiment, ions may enter through one end of array 347, be focused by a quadrupole field toward one of axes 371, 373, 375, or 377, and move, under the influence of the ion initial kinetic energy, via diffusion, or Coulombic influences through array 347 toward and out of the opposite end of the array. In accordance with equations (8)-(14), potentials can be applied at conducting plates 354-358 and 378-382 so that array 347 acts to transmit ions over a broad or narrow mass range from an entrance of the array to an exit end—i.e. along the z-axis. Alternatively, in accordance with equations (8)-(14), the motion of ions of selected masses or mass ranges may be excited so as to radially eject unwanted ions while transmitting ions having desired masses.

Ions transmitted by array 347 may be all from the same ion source. Alternatively, ions transmitted along one of the axes—for example axis 371—may originate from a first sample via a first ion source whereas ions transmitted along another axis—for example axis 375—may originate from second sample via a second ion source. Further, a first type of ion might be transmitted along one axis whereas a second type of ion may be transmitted simultaneously along a second axis of array 347. For example, negative ions may be injected into array 347 along axis 371 while simultaneously positive ions are injected into the array along axis 377. In this way both positive and negative ions might be transmitted or analyzed simultaneously.

According to an alternate method of operation, potentials are applied to conductive plates 354-358 and 378-382 so as to form not four abridged quadrupole fields but rather just two or only one. According to this method, two abridged quadrupolar fields are formed, one about each of axes 372 and 376 by applying the potential $3\Phi_o(t)$ at plates 354, 380, and 358, the potential $-3\Phi_o(t)$ at plates 378, 356, and 382, and ground potential at plates 355, 379, 357, and 381. Each of the abridged quadrupole fields thus formed would cover half the volume between sets 348 and 349. Alternatively, a single abridged quadrupole field covering the entire volume between sets 348 and 349 can be formed about axis 374 by applying the potential $6\Phi_o(t)$, at plates 354 and 382, the potential $-6\Phi_o(t)$ at plates 378 and 358, the potential $3\Phi_o(t)$ at plates 355 and 381, the potential $-3\Phi_o(t)$ at plates 379 and 357, and ground potential at plates 356 and 380.

In further alternate methods, not all of the quadrupoles in array 347 need be operated simultaneously. Rather, potentials may be applied between selected plates while others are not actively driven. For example, the potential $3\Phi_o/2$ may be applied at plates 354 and 379 and the potential $-3\Phi_o/2$ may be applied at plates 378 and 355 while all other plates 356-358 and 380-382 are held at ground potential. In this way, an abridged quadrupole field is formed only about axis 371.

In alternate embodiments, the width of each support may be, for example, 5 mm, however, the height of the supports varies. For example, in one alternate embodiment, elements 363 and 364 are 5 mm in height, elements 365 and 366 are 6.67 mm in height, elements 367 and 368 are 8.33 mm in height, and elements 369 and 370 are 10 mm in height—i.e. along the y-axis. In one such alternate embodiment, element sets 348 and 349, modified to comprise elements that are 5, 6.67, 8.33, and 10 mm high are still positioned facing, and parallel to each other and having an $r_o$ of 0.833 mm. Note that element 363 having a height of 5 mm in set 348 is adjacent to and aligned with element 364 having a height of 5 mm in set 349. Similarly, the elements having heights of 6.67, 8.33, and 10 mm in set 348 are adjacent to and aligned with the elements having heights of 6.67, 8.33, and 10 mm respectively in set 349. In one preferred method, the potential $3\Phi_o(t)/2$ is applied at plates 354, 356, 358, 379 and 381 and the potential $-3\Phi_o(t)/2$ is applied at plates 355, 357, 378, 380, and 382. As described above, if element 363-370 were the same size, the field strength about each axis 371, 373, 375, and 377 would be the same, however, because elements 363-370 in the present alternate embodiment have different heights from one another, the field strength will also vary from one abridged quadrupole to the next within this alternate embodiment array. Abridged quadrupoles having supports of heights 6.67, 8.33, and 10 mm will have field strengths 0.75, 0.6, and 0.5 times respectively the field strength of the abridged quadrupole having supports of 5 mm height. This difference in field strength will result in the transmission of different masses or mass ranges through the different abridged quadrupoles of the array. The abridged quadrupole having supports of 5 mm height will transmit ions of higher mass while simultaneously the abridged quadrupole having supports of 10 mm height will transmit ions of lower mass. In this manner, an abridged quadrupole array can be made and operated so as to transmit ions wherein the transmitted mass is a function of position within the array.

Further, in embodiments where the extent of the fields of the abridged quadrupole array are small along the x-axis—e.g. $r_o$<0.5 mm—the abridged quadrupole array may act as a "miniature" abridged quadrupole array—i.e. taking on many of the attributes of prior art miniature quadrupole arrays. For example, when $r_o$ is sufficiently small, the abridged quadrupole array may be operated at elevated pressures.

Figure 11:
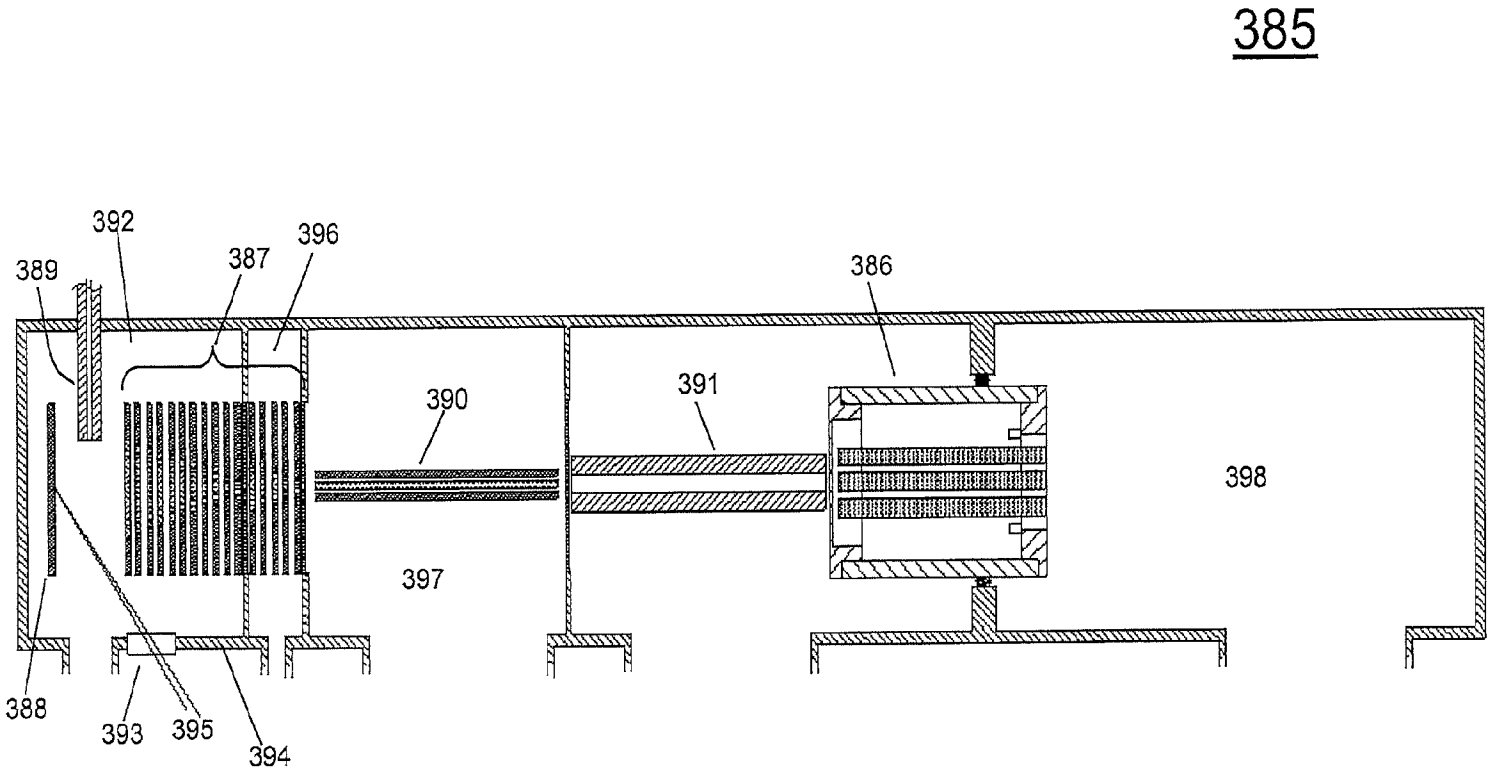
FIG. 11 shows a mass spectrometry system including an ion source, an ion guide, an abridged quadrupole, and a mass analyzer.

The various embodiments of the abridged multipoles and abridged quadrupoles described above may be incorporated into a wide variety of mass spectrometry systems. Any number of abridged multipoles arranged in parallel or in series may be used in conjunction with any prior art ion production means, any combination of other types of mass analyzers, collision cells, ion detectors, digitizers, and computer and software systems. However, as an example, shown in FIG. 11 is mass spectrometry system 385, including collision cell 386, ion guide 387, MALDI target 388, orthogonal glass capillary 389 by which ESI ions may be introduced, multipole ion guide 390, and abridged quadrupole 391. Either MALDI or ESI may be used to produce ions simultaneously, in close succession, or independently. Of course, any other prior art ionization means may be used to produce ions in conjunction with the present embodiment.

Gas and ions are introduced from, for example, an elevated pressure ion production means (such as electrospray ionization) into chamber 392 via capillary 389. After exiting capillary 389 the directional flow of the ions and gas will tend to continue in the direction of the capillary axis. Deflection electrode 388 is preferably a planar, electrically conducting electrode oriented perpendicular to the axis of ion guide 387 and parallel to the axis of capillary 389. A repulsive potential is applied to electrode 388 so that ions exiting capillary 389 are directed toward and into the inlet of ion guide 387. Through a combination of DC and RF potentials and the flow of gas—by methods well known in the prior art—ions are passed through ion guide 387 and into downstream optics.

Alternatively, ions may be produced by Matrix-Assisted Laser Desorption/Ionization (MALDI). To produce MALDI ions, samples are prepared and deposited onto electrode 388. Window 393 is incorporated into the wall of chamber 394 such that laser beam 395 from a laser positioned outside the vacuum system may be focused onto the surface of electrode 388 such that the sample thereon is desorbed and ionized. Again, a repulsive potential on electrode 388 directs the MALDI ions into ion guide 387.

As known from the prior art, two stage ion guide 387 (a.k.a. an ion funnel) is capable of accepting and focusing ions even at a relatively high pressure (i.e., ~1 mbar in first pumping chamber 392) and can efficiently transmit them through a second, relatively low pressure differential pumping stage (i.e., ~$5\times10^{-2}$ mbar in second pumping chamber 396) and into a third pumping chamber 397. Once in chamber 397 ions pass into and through RF multipole ion guide 390. RF multipole ion guide 390 is constructed and operated by methods known in the prior art. Ion guide 390 may be a quadrupole, hexapole, octapole, or other higher order multipole. In alternate embodiments, ion guide 390 may be an abridged multipole— for example, an abridged quadrupole. While in ion guide 390, ions undergo collisions with gas molecules and are thereby cooled towards the axis of the ion guide. After passing through ion guides 387 and 390, the ions are mass analyzed by abridged quadrupole 391. That is, ions of a selected mass-to-charge ratio are passed from ion guide 390 to collision cell 386 via abridged quadrupole 391 while rejecting substantially all other ions. In order to avoid collisions with gas interfering with the mass analysis, the pressure in abridged quadrupole 391 should be maintained at $10^{-5}$ mbar or less. In the present embodiment, a DC potential is applied between all adjacent elements so as to force the ions through the system from upstream elements (e.g., funnel 387) toward downstream elements (e.g., cell 386)—that is, from left to right in FIG. 11.

Collision cell 386 is comprised of an RF multipole ion guide in an enclosed volume and is constructed and operated by methods known in the prior art. Collision cell 386 may include a quadrupole, hexapole, octapole, or other higher order multipole. In alternate embodiments, the RF multipole ion guide of the collision cell may be an abridged multipole—for example, an abridged quadrupole. The gas pressure in collision cell 386 is preferably $10^{-3}$ mbar or greater. Typically the gas is inert (e.g., Nitrogen or Argon), however, reactive species might also be introduced into the cell. When the potential difference between abridged quadrupole 391 and cell 386 is low, for example 5 V, the ions are simply transmitted therethrough. That is, the energy of collisions between the ions and the gas in ion guide 386 is too low to cause the ions to fragment. However, if the potential difference between abridged quadrupole 391 and cell 386 is high, for example 100 V, the collisions between the ions and gas may cause the ions to fragment.

From collision cell 386, ions are released into region 398 where the precursor and fragment ions may be analyzed by a mass analyzer (not shown). The mass analyzer used to analyze the ions released from collision cell 386 may be any known prior art analyzer including a time-of-flight mass analyzer, an ion cyclotron resonance mass analyzer, an orbitrap, quadrupole trap, a quadrupole filter, or an abridged quadrupole according to the present invention. It should also be noted that abridged quadrupole 391 may be operated in any manner consistent with equations (8) through (14). Such operation may include, for example, transmission over a broad mass range by applying an RF-only potential, transmission over a narrow mass range by applying RF and DC potentials, or transmission of notched mass ranges by applying an RF-only potential to radially confine ions and an AC potential for resonant excitation of ions at specific frequencies to eliminate unwanted mass ranges.

It should be recognized that any of the above embodiments may be fabricated by any known prior art methods—for example, electrical discharge machining or micromachining. In further alternate embodiments, miniaturized abridged quadrupoles may be fabricated by micromachining methods—masking, etching, thin layer depositions, etc.—used in the semiconductor or microfluidics industries.

The abridged multipole according to the present invention overcomes many of the limitations of prior art multipoles discussed above. The RF devices disclosed herein provide a unique combination of attributes making it especially suitable for ion transport and for use in the mass analysis of a wide variety of samples.

While the present invention has been described with reference to one or more preferred and alternate embodiments, such embodiments are merely exemplary and are not intended to be limiting or represent an exhaustive enumeration of all aspects of the invention. The scope of the invention, therefore, shall be defined solely by the following claims. Further, it will be apparent to those of skill in the art that numerous changes may be made in such details without departing from the spirit and the principles of the invention. It should be appreciated that the present invention is capable of being embodied in other forms without departing from its essential characteristics.

What is claimed is:

1. An abridged multipole structure for the transport and selection of ions along an axis in a vacuum system, comprising:

a plurality of rectilinear electrode structures, each having a substantially planar face with a first dimension and a second dimension perpendicular to the first dimension, a set of electrically conductive electrodes, an electrical divider network electrically connecting the electrodes of the set and a voltage applied to the extents of the rectilinear structure across the second dimension, wherein the electrodes and the electrical divider network are constructed so that voltages applied to the electrodes across the second dimension produce an electrical potential at the planar face whose amplitude is a linear function of position along the second dimension; and a source that applies an RF potential across the second dimension of each of the electrode structures to produce a multipole field to focus analyte ions toward the axis.

2. The structure of claim 1 wherein each electrode structure is comprised of a plurality of elements arranged in a stack extending across the second dimension, wherein each element is a strip with a long dimension extending along the axis, and wherein each set of electrically conductive electrodes have equal widths along the second dimension and which are spaced at equal intervals along a line in the second dimension.

3. The structure of claim 2 wherein each of the elements is comprised of an electrically resistive layer and a plurality of electrically conductive layers, all of the layers being mounted on at least one insulating support.

4. The structure of claim 3 wherein the resistive layer is positioned on the planar face.

5. The structure of claim 3 wherein the electrically resistive layer and the plurality of electrically conductive layers are shaped and positioned on the support so that the electrically resistive layer and the plurality of conductive layers are capacitively coupled to the extent that an application of a voltage between the conductive layers produces a potential on the electrically resistive layer which varies substantially linearly with respect to position on the electrically resistive layer between the conductive layers.

6. The structure of claim 1 further comprising a mechanism that positions the plurality of rectilinear electrode structures so that, for each rectilinear electrode structure, the planar face faces a central axis and the first dimension extends along the central axis, wherein the mechanism that positions the plurality of rectilinear electrode structures positions the electrode structures so that a cross section of the electrode structures perpendicular to the central axis is a polygon.

7. The structure of claim 6 wherein the polygon is a hexagon.

8. The structure of claim 6 wherein the polygon is a rectangle.

9. The structure of claim 6 wherein the polygon is a square.

10. The structure of claim 1 further comprising a mechanism that positions the plurality of rectilinear electrode structures so that, for each rectilinear electrode structure, the planar face faces a central axis and the first dimension extends along the central axis, wherein the mechanism that positions the plurality of rectilinear electrode structures positions two electrode structures parallel to each other and on opposite sides of said central axis.

11. The structure of claim 1 further comprising a mechanism that positions the plurality of rectilinear electrode structures so that, for each rectilinear electrode structure, the planar face faces a central axis and the first dimension extends along the central axis, wherein the vacuum system includes a first chamber and a second chamber and a pumping restriction between the first and second chambers and wherein the mechanism that positions the plurality of rectilinear electrode structures positions the electrode structures to form a closed tubular structure having a first end positioned in the first chamber and a second end positioned in the second chamber and extending through the pumping restriction so that ions may be transported from the first chamber to the second chamber via the closed tubular structure, but flow of gas between the first and second chambers is restricted.

12. The structure of claim 11 wherein the inscribed diameter of the tubular structure is larger at the first end than the inscribed diameter at the second end.

13. The structure of claim 1 wherein the electrical divider network is comprised of one of resistors, capacitors and inductors.

14. The structure of claim 13 wherein resistors, capacitors and inductors all have the same electrical value.

15. An abridged multipole structure for the transport and selection of ions along a plurality of axes in a vacuum system, comprising:

a plurality of rectilinear electrode structures, each having a substantially planar face with a first dimension and a second dimension perpendicular to the first dimension, a set of electrically conductive electrodes, an electrical divider network electrically connecting the electrodes of the set and a voltage applied at the extents of the rectilinear electrode structure across the second dimension, wherein the electrodes and the electrical divider network are constructed so that voltages applied to the electrodes across the second dimension produce an electrical potential at the planar face whose amplitude is a linear function of position along the second dimension;

a source that applies an RF potential across the second dimension of each of the electrode structures to produce a multipole field to focus analyte ions toward one of the plurality of axes; and a mechanism that positions the plurality of rectilinear electrode structures so that, for each electrode structure, the planar face faces one of the plurality of axes and the first dimension extends along that one axis.

16. A mass spectrometer comprising:

an ion source;

a vacuum system having an axis;

an ion detector; and an abridged multipole structure for the transport and selection of ions along the axis including a plurality of rectilinear electrode structures, each having a substantially planar face with a first dimension and a second dimension perpendicular to the first dimension, a set of electrically conductive electrodes, an electrical divider network electrically connecting the electrodes of the set and a voltage applied at the extents of the rectilinear electrode structure across the second dimension, wherein the electrodes and the electrical divider network are constructed so that voltages applied to the electrodes across the second dimension produce an electrical potential at the planar face whose amplitude is a linear function of position along the second dimension; and a source that applies an RF potential across the second dimension of each of the electrode structures to produce a multipole field to focus analyte ions toward the axis.

17. A method for transporting and selecting ions along an axis in a vacuum system, comprising:

providing a plurality of rectilinear electrode structures, each having a substantially planar face with a first dimension and a second dimension perpendicular to the first dimension, a set for electrically conductive electrodes, an electrical divider network electrically connecting the electrodes of the set and a voltage applied at the extents of the rectilinear electrode structure across the second dimension, wherein the electrodes and the electrical divider network are constructed so that voltages applied at the extents of the rectilinear electrode structure across the second dimension produce an electrical potential at the planar face whose amplitude is a linear function of position along the second dimension; and applying an RF potential across the second dimension of each of the electrode structures to produce a multipole field to focus analyte ions toward the axis.

18. The method according to claim 17 further comprising:

providing a source of analyte ions; and injecting the analyte ions into the vacuum system along the central axis between the plurality of rectilinear electrode structures so that the RF multipole field produced by the plurality of rectilinear electrode structures confines ions radially about the central axis.

19. The method of claim 17 further comprising positioning four electrode structures to form a multipole structure having a square cross section, and the step of applying an RF potential comprises applying voltages to the four electrode structures to produce an electrical potential within the multipole structure that has an amplitude $\phi(t)$ according to the equation $\phi(t)=-\phi_o(t)\cdot x\cdot y/(2r_0^2)$ wherein $\phi_o(t)$ is a voltage applied across the second dimension of each of the four electrode structures, x is a position along the second dimensions of first opposing electrode structures, y is a position along the second dimensions of second opposing electrode structures positioned perpendicularly to the first opposing electrode structures and $r_o$ is the distance between opposing electrode structures.

20. The method of claim 19 wherein the waveform $\Phi_o(t)$ includes an RF and a DC component.

21. The method of claim 20 further comprising:

(d) providing a source of analyte ions;

(e) injecting the analyte ions along the central axis into the multipole structure; and (f) selecting the amplitude and frequency of the RF component and the magnitude of the DC component such that ions of a predetermined mass or mass range follow stable trajectories through the multipole structure whereas ions outside said mass range follow unstable trajectories and are not transmitted through the multipole structure.

22. The method of claim 21 further comprising:

(g) arranging the four electrode structures such that gaps exist between the electrode structures;

(h) providing ion detectors positioned adjacent to said gaps; and (i) detecting ions which follow unstable trajectories and pass out of the multipole structure through said gaps.

23. A method for the transport and selection of ions along a central axis, comprising:

providing a plurality of rectilinear electrode structures, each having a substantially planar face with a first dimension and a second dimension perpendicular to the first dimension, a set of electrically conductive electrodes, an electrical divider network electrically connecting the electrodes of the set and a voltage applied at the extents of the rectilinear electrode structure across the second dimension, wherein the electrodes and the electrical divider network are constructed so that voltages applied at the extents of rectilinear electrode structure across the second dimension produce an electrical potential at the planar face whose amplitude is a linear function of position along the second dimension;

(b) applying an RF potential across the second dimension of each of the electrode structures to produce a multipole field to focus analyte ions toward the axis; and (c) applying potentials to the extents of the electrode structures such that the electrode structures generate potentials which are linear functions of position along the second dimensions of each electrode structure in order to form a substantially homogeneous dipole field having field lines orthogonal to the central axis.

24. The method of claim 23 wherein the homogeneous dipole field is a periodic function of time.

25. The method of claim 24 wherein the homogeneous dipole field has a fixed amplitude and rotates about the central axis.

26. The method according to claim 23 wherein step (c) comprises applying potentials including an RF component to the electrode structures and the method further comprises:

(d) providing a source of analyte ions;

(e) injecting the analyte ions along the central axis into the multipole structure; and (f) selecting an amplitude and frequency of the RF component and an amplitude and frequency of oscillation of the homogeneous dipole field to excite motion of ions having masses within a predetermined mass range.

27. A method according to claim 26 wherein step (f) comprises selecting an amplitude and frequency of the RF component and an amplitude and frequency of oscillation of the homogeneous dipole field to excite ions having masses within a predetermined mass range to a range of motion sufficient to remove the ions from the multipole structure by causing the ions to impinge onto the electrode structures or to be ejected from the multipole structure.

* * * * *